US012172736B1

(12) United States Patent
Timothy

(10) Patent No.: US 12,172,736 B1
(45) Date of Patent: Dec. 24, 2024

(54) CONTROL SYSTEM TO KEEP A DIRECTION OF TRAVEL OF A BOAT CENTERED AXIALLY ON A DEFINED PATH BETWEEN TWO POINTS

(71) Applicant: Arthur James Timothy, Amersham (GB)

(72) Inventor: Arthur James Timothy, Amersham (GB)

( * ) Notice: Subject to any disclaimer, the term of this patent is extended or adjusted under 35 U.S.C. 154(b) by 395 days.

(21) Appl. No.: 17/677,799

(22) Filed: Feb. 22, 2022

Related U.S. Application Data

(60) Provisional application No. 63/299,571, filed on Jan. 14, 2022.

(51) Int. Cl.
*B63B 49/00* (2006.01)
*B63B 79/10* (2020.01)
*B63H 25/04* (2006.01)

(52) U.S. Cl.
CPC ..... *B63B 79/10* (2020.01); *B63B 49/00* (2013.01); *B63H 25/04* (2013.01); *B63B 2213/02* (2013.01)

(58) Field of Classification Search
CPC ..... B63B 79/10; B63B 49/00; B63B 2213/02; B63H 25/04
USPC ..... 701/21
See application file for complete search history.

(56) References Cited

U.S. PATENT DOCUMENTS 5,694,337 A * 12/1997 Macken ..... G01L 5/103 700/91
6,026,759 A 2/2000 Hazelett et al.
8,534,214 B1 9/2013 Gasper
9,207,675 B1 * 12/2015 Walser ..... G01C 21/3807
9,944,363 B2 4/2018 Venables et al.
10,272,970 B2 4/2019 Watts et al.
10,625,831 B2 4/2020 Venables et al.
10,703,449 B2 7/2020 Skauen
10,717,502 B1 7/2020 Hartman
11,067,979 B2 7/2021 Green et al.
11,130,551 B1 9/2021 Hartman
2005/0092225 A1 * 5/2005 Kaji ..... B63H 25/42 114/144 R
2007/0173141 A1 * 7/2007 Hine ..... B63H 19/02 440/13
2015/0261222 A1 * 9/2015 Morikami ..... B63H 25/38 701/21
2017/0277189 A1 * 9/2017 Johnson ..... B63H 25/06
2018/0229823 A1 * 8/2018 Inoue ..... G05D 1/0208
(Continued)

*Primary Examiner* — Ian Jen
*Assistant Examiner* — Hossam M Abd El Latif
(74) *Attorney, Agent, or Firm* — Maiorana Patent Law, PA

(57) ABSTRACT

An apparatus comprising a processor and an actuator. The processor may be configured to generate a control signal in response to an actual path of a boat determined in response to signals received from GNSS satellites and a centerline path of the boat. The actuator may be configured to move a control surface mounted on a centerline of the boat in response to the control signal. The processor may be configured to calculate the control signal by comparing the actual path of the boat relative to the centerline path. The control signal may be calculated by the processor in real time as the actual path of the boat changes in response to a deviation from the centerline path caused by a force acting on the boat. The control surface may provide adjustments to the actual path of the boat to center the actual path axially along the centerline path.

20 Claims, 11 Drawing Sheets

(56) References Cited

U.S. PATENT DOCUMENTS

| | | | | |
|---|---|---|---|---|
| 2022/0126972 | A1* | 4/2022 | Venables | B63H 25/44 |
| 2022/0266974 | A1* | 8/2022 | Sakurada | B63H 25/06 |

* cited by examiner

CONTROL SYSTEM TO KEEP A DIRECTION OF TRAVEL OF A BOAT CENTERED AXIALLY ON A DEFINED PATH BETWEEN TWO POINTS

This application relates to U.S. Provisional Application No. 63/299,571, filed on Jan. 14, 2022, which is hereby incorporated by reference in its entirety.

FIELD OF THE INVENTION

The invention relates to boats generally and, more particularly, to a method and/or apparatus to implement a control system to keep a direction of travel of a boat centered axially on a defined path between two points.

BACKGROUND

In competitive water skiing, in some events, such as the slalom and jump events, a boat is required to drive along a predetermined path to pull a skier through a water ski run. The predetermined path is in a geographical space marked out on the water by floating buoys. The accuracy with which the boat must adhere to the predetermined path can be as rigorous as +/−20 cm in the case of a slalom event and +/−40 cm in the case of a jump event. The boat drivers have to be extremely skilled to maintain paths within such tolerances while countering the short term loads to the boat caused by the skier. At the upper levels of tournament, a skier can exert short term loads in excess of 500 kg almost perpendicular to the direction of travel of the boat.

Water ski boats designed for tournament usage currently utilize a conventional rudder mounted at the rear of the boat, either just in front of the transom (i.e., inboard designs) or just behind the transom (i.e., stern drive or outboard designs). Some water ski boats also implement static stabilizer fins, which give lateral stability to the boat, usually mounted just ahead of midships. The skier is attached to the boat via a rope which in turn is attached to a metal pylon mounted substantially at the center of the length of the boat.

A conventional rudder is primarily designed such that when rotated from the central neutral position, it exerts a lateral force at the rear of the boat. The lateral force at the rear of the boat results in yaw (i.e., rotation in the horizontal plane) with respect to the original direction of travel. The yaw changes the direction of the boat. In the case of a boat traveling through a slalom water ski course, a correction to a movement away from the predetermined path (i.e., the so called centerline) is achieved by first yawing the boat back towards the centerline, waiting for the boat to approach the centerline and then applying yaw in the opposite direction as the boat reaches the centerline again. With skilled driving, the timing of the yaw changes coincides with the boat reaching the centerline so as not to overshoot. The large, short duration lateral forces applied by the skier on the boat result in additional complications to correcting the movement. Since there is a certain timescale associated with making the boat yaw, if the driver is unable to apply some anticipation of the lateral forces and become "in sync" with the skier, the driving can become totally reactive and is not as good for the skier as so called "proactive" driving.

Stabilizer fins have been used on boats for a long time. Stabilizer fins are implemented as static and moveable embodiments and can be found on various locations below the water line around the hull of the boat. The most common uses for dynamic fins have been to control pitching (i.e., end to end oscillation in the vertical plane) and roll (i.e., sideways rotation about the end to end axis of the boat). For controlling pitch and roll, the stabilizer fins are mounted away from the centerline of the hull and on both sides of the hull to have maximum effect. In the case of wake and surf boats, some stabilizer fins are used to control the attitude of the boat in the water when under way at the slow speeds required for wake surfing (i.e., approximately 10 mph). For wake and surf boats, the stabilizer fins may control the size, shape and handedness of the wake of the boat. However, at higher speeds, the stabilizer fins are necessarily set to zero degrees relative to the direction of travel and therefore no longer have an effect.

It would be desirable to implement method and/or apparatus that implements a control system to keep a direction of travel of a boat centered axially on a defined path between two points without resorting to the use of yaw.

SUMMARY

The invention concerns an apparatus comprising a processor and an actuator. The processor may be configured to generate a control signal in response to an actual path of a boat determined in response to signals received from GNSS satellites and a predetermined centerline path of the boat. The actuator may be configured to move a control surface mounted on a centerline of the boat in response to the control signal. The processor may be configured to calculate the control signal by comparing the actual path of the boat relative to the predetermined centerline path. The control signal may be calculated by the processor in real time as the actual path of the boat changes in response to a deviation from the predetermined centerline path caused by a force acting on the boat. The control surface may provide adjustments to the actual path of the boat to center the actual path axially along the predetermined centerline path.

BRIEF DESCRIPTION OF THE FIGURES

Embodiments of the invention will be apparent from the following detailed description and the appended claims and drawings.

DETAILED DESCRIPTION OF THE EMBODIMENTS

Figure 1:
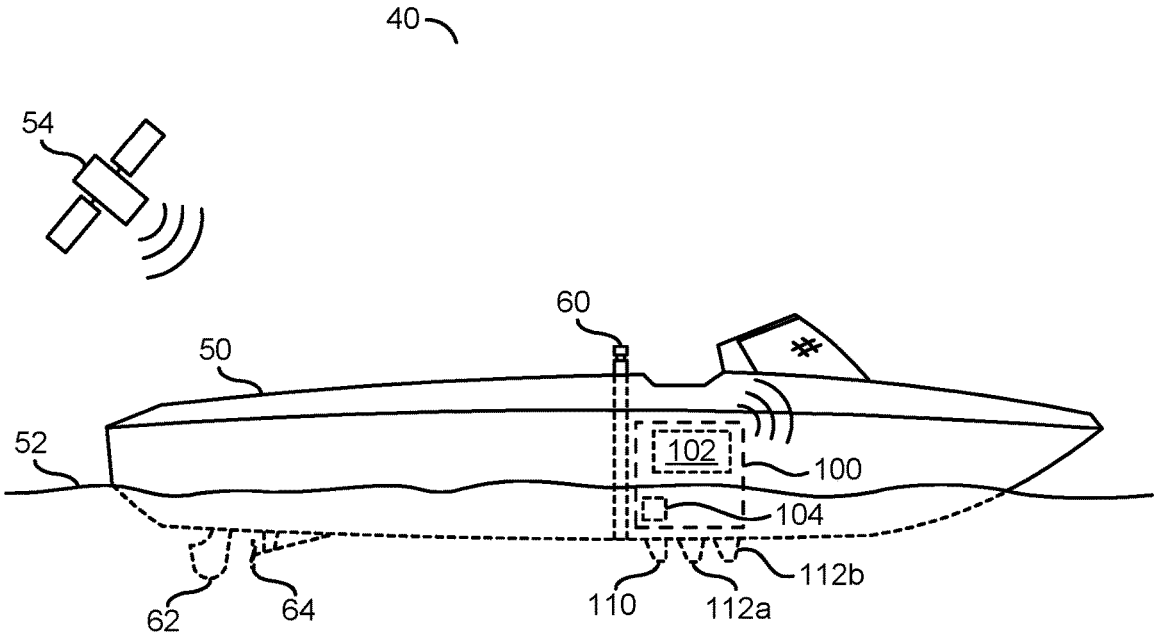
FIG. 1 is a diagram illustrating an example embodiment of the present invention.

Embodiments of the present invention include providing a method and/or apparatus that implements a control system to keep a direction of travel of a boat centered axially on a defined path between two points that may (i) compare an actual path of a boat with a predetermined centerline path of a water ski run, (ii) enable correction of a direction of a boat without inducing yaw, (iii) assist in positioning a boat for high level competitive water skiing, (iv) calculate control signals for an actuator to dynamically adjust a fin position in real time, (v) control fins implemented along a centerline of a boat near a support pylon, (vi) determine an actual position of a boat using GNSS location technology, (vii) rotate a fin to automatically provide deviation correction without inducing yaw while a boat is steered, (viii) control a trim tab of a fin to automatically provide deviation correction without inducing yaw while a boat is steered, and/or (ix) enable tracking a water ski boat within a boat lane.

Embodiments of the present invention may be configured to determine an actual position of a boat with respect to a predetermined centerline position. A control signal may be generated to move a control surface (e.g., a fin) mounted on a centerline of the boat. The control signal may be calculated based on the actual position of the boat and the predetermined centerline position in order to provide adjustments to the actual path of the boat. The adjustments may be performed to center the actual path axially along the predetermined centerline path. For example, the predetermined centerline path may be a path defined between two points (e.g., a start of a water ski course and an end of a water ski course).

Real time kinematic (RTK) technology for the Global Navigation Satellite System (GNSS) may be implemented to enable the actual position of the boat to be determined. Embodiments of the present invention may be configured to interpret signals received using GNSS to determine the actual position of the boat. Any satellite navigation constellations and/or combinations of satellite navigation constellations may be used (e.g., GPS, GLONASS, Galileo, Beidou, etc.).

Embodiments of the present invention may implement the control signal in order to dynamically adjust one or more control surfaces (e.g., fins) mounted midships on a centerline of the hull. An orientation of the fins in the water may be adjusted by the control signal to apply corrective lateral forces on the boat. The corrective forces and/or the orientation of the fins may be determined in order to move the boat laterally in physical space without inducing any yaw on the boat. Embodiments of the present invention may be configured to quickly counteract lateral forces exerted by the skier on the boat. The timescales of corrective actions implemented may be quick enough to negate a need for predictive corrections to be applied by a driver of the boat, based on the longitudinal position of the boat in the slalom or jump course. For example, with the corrections applied using the control signal, the driver may entirely rely on "reactive" corrections with little adverse effect on the skier.

Referring to FIG. 1, a diagram illustrating an example embodiment of the present invention is shown. An example scenario 40 is shown. In the scenario 40, a boat 50 is shown in water 52. In an example, the water 52 may be a lake used for water skiing. In the example scenario 40, a view of the length of the boat 50 is shown.

A satellite 54 is shown. While the satellite 54 is shown as a single satellite, the satellite 54 may represent a constellation of satellites. The satellite 54 may be configured to communicate signals that may be used to determine a geographical location.

A pylon 60 is shown attached to the boat 50. The pylon 60 may implement a support pylon for a water skier. In an example, the pylon 60 may be a metal pylon mounted substantially at the center of the length of the boat 50. A tow line (e.g., a rope) may be attached to the pylon 60 to enable the boat 50 to pull a water skier while the boat 50 moves across the water 52. The pylon 60 may be located substantially at the center of the length of the boat 50 in order to prevent a force caused by the water skier from creating a yaw rotation of the boat 50.

The boat 50 is shown comprising a rudder 62 and a propeller 64. The rudder 62 may be a rear rudder. The rudder 62 and the propeller 64 may be located near a stern of the boat 50. The rudder 62 may be configured to enable a driver to steer the boat 50. Moving a direction of the rudder 62 may cause a yaw rotation to the boat 50, which may cause the direction of the boat 50 to change. The propeller 64 may be configured to move the boat 50 through the water 52.

The boat 50 is shown comprising a block (or circuit) 100. The circuit 100 may comprise a control device. The apparatus 100 may comprise a block (or circuit) 102 and/or a block (or circuit) 104. The circuit 102 may implement a processor. The circuit 104 may implement an actuator. The apparatus 100 may comprise other components (not shown). The number, type and/or arrangement of the components of the apparatus 100 may be varied according to the design criteria of a particular implementation.

The apparatus 100 is shown communicating with the satellite 54. The apparatus 100 may be configured to receive signals from the satellite 54. The apparatus 100 may be configured to determine an actual position of the boat 50. The actual position may be a geographic location of the boat 50.

The communication of the satellite 54 and the apparatus 100 may enable a highly accurate version of differential GPS technology (e.g., RTK GPS). In an example, the satellite 54 may communicate with a base receiver and the base receiver may communicate with a rover receiver (both not shown). The base receiver may be installed at a known fixed position. The base receiver may compare live position data from the satellite 54 with the known fixed position to generate error signals. The error signals may be transmitted to the rover receiver.

The rover receiver may be implemented by the apparatus 100 and/or on the boat 50. The rover receiver may perform calculations using the error signals received from the base receiver. The rover receiver may calculate a position relative to the base receiver with a higher amount of accuracy than standard GPS. The rover receiver may be used to measure buoy positions and/or to dynamically track the position of the boat 50. Standard differential GPS (DGPS) may improve GPS accuracy from +/−5 meters to approximately +/−2 meters. In addition to DGPS, the RTK GPS implemented by the satellite 54 and/or the apparatus 100 may measure variations in the phase of the GPS carrier waves to achieve an accuracy of +/−1 centimeters if the rover receiver is within 10 km of the base receiver.

The positional accuracy provided by the satellite 54 and/or the apparatus 100 may be the accuracy of the rover beacon relative to the base beacon. For water skiing, absolute position is not important, since all buoy/boat positions are required to be accurate relative to certain buoys (entrance/exit gates for slalom, "start time" and "mid time" buoys for jump). The positions of the buoys may be measured accurately relative to the position of the base beacon and the positions relative to each other may be considered to be accurate. There may be position tolerances defined in terms of distances relative to multiple other buoys in a course (e.g., ski buoys may conform to diagonal, axial and longitudinal distances). Whether a buoy is in tolerance depends on the actual position of other related buoys.

The boat 50 may comprise a control surface 110 and/or fins 112*a*-112*b*. The control surface 110 may be implemented as an adjustable fin. For example, the adjustable fin 110 may implement a corrective surface. The fins 112*a*-112*b* may implement static fins and/or tracking fins. The adjustable fin 110 and the fins 112*a*-112*b* may be located on the boat 50 near the location of the pylon 60. In an example, the adjustable fin 110 and/or the fins 112*a*-112*b* may implement stabilizer fins. While one adjustable fin 110 and two fins 112*a*-112*b* are shown as a representative example, more than one implementation of the adjustable fin 110 and/or more or fewer of the static fins 112*a*-112*b* may be implemented. The number of implementations of the adjustable fin 110 and/or the static fins 112*a*-112*b* may be varied according to the design criteria of a particular implementation.

The processor 102 may be configured to generate a control signal. The processor 102 may be configured to determine an actual location and/or path of the boat 50 based on communications with the satellite 54. The processor 102 may compare the actual path of the boat 50 to a predetermined centerline path for the ski course. The control signal may be generated based on the comparison to enable corrective actions to be performed using the actuator 104. The corrective actions may keep a direction of travel of the boat 50 centered axially on a defined path between the start point and the finish point of the water ski course.

The actuator 104 may be configured to move the adjustable fin 110 in response to the control signal. The control signal may be calculated by the processor 102 in real-time as the actual path of the boat 50 deviates from the predetermined centerline path of the water ski course. The actuator 104 may react to the control signal to provide the movement of the adjustable fin 110. The adjustable fin 110 may be configured to be moved by the actuator 104. The movement of the adjustable fin 110 may cause corrective lateral forces to be applied to the boat 50. The movement of the adjustable fin 110 caused by the actuator 104 may provide adjustments to the actual path of the boat 50 to center the actual path axially along the predetermined centerline path. The processor 102 may continually and/or continuously receive (or calculate) updated location coordinates to determine the actual path as the steering by the driver of the boat 50 and/or the corrective forces created by the movement of the adjustable fin 110 change the position of the boat 50 in the water 52.

Figure 2:
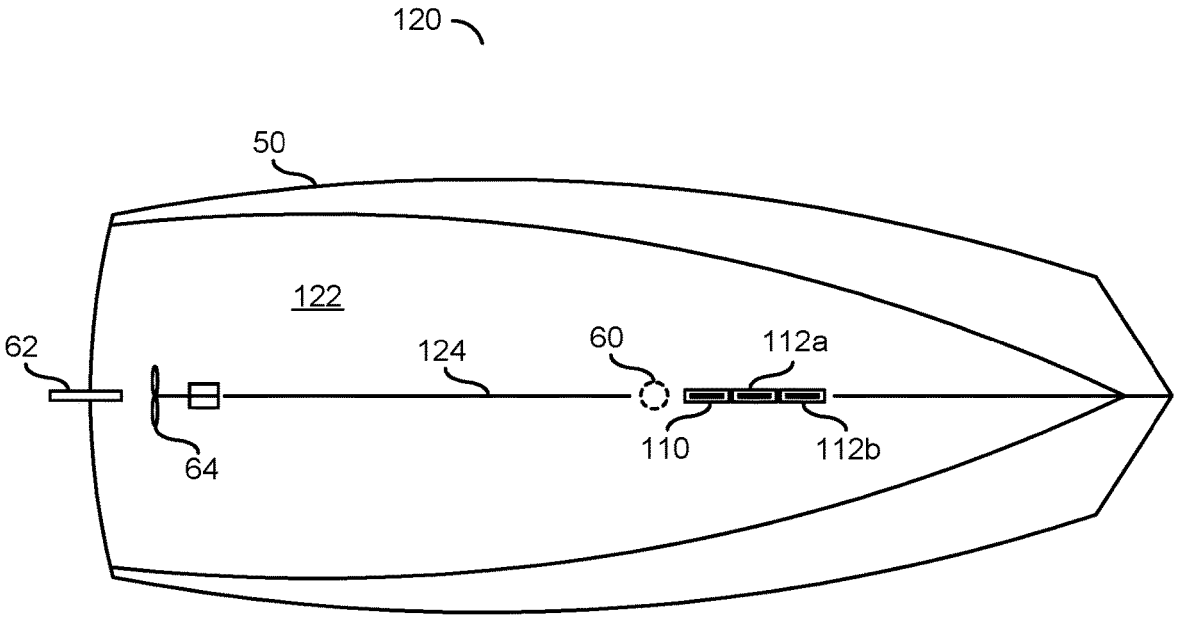
FIG. 2 is a diagram illustrating a bottom view of a hull of a boat.

Referring to FIG. 2, a diagram illustrating a bottom view of a hull of a boat is shown. A view 120 is shown. The view 120 may comprise of a bottom of the boat 50. For example, the view 120 may illustrate a view from below the water 52 looking up at the boat 50. The rudder 62, the propeller 64, the adjustable fin 110 and the tracking fins 112*a*-112*b* are shown.

A hull 122 of the boat 50 is shown. The hull 122 may be on the underside of the boat 50. The hull 122 may be generally within the water 52 while the boat 50 is carrying a water skier down a ski run. In an example, for water ski boats, the hull 122 may have a shallow design. The shallow design of the hull 122 may be implemented so that any roll induced on the boat 50 may be negligible.

The dotted circle representing the location of the pylon 60 on the boat 50 is shown. The pylon 60 may not extend through the hull 122 of the boat 50. The location of the pylon 60 is shown for reference to the location of the adjustable fin 110 and the tracking fins 112*a*-112*b*. In the example shown, the adjustable fin 110 and the tracking fins 112*a*-112*b* may be located slightly towards the front of the boat 50 with respect to the pylon 60.

A line 124 is shown along the hull 122. The line 124 may represent a centerline of the boat 50. The centerline 124 may extend from a front (e.g., bow) to the rear (e.g., stern) of the boat 50. The centerline 124 may bisect the length of the boat 50 (e.g., divide the width of the boat 50 into two equal areas).

The adjustable fin 110 and the tracking fins 112*a*-112*b* may be located along the centerline 124. Locating the control surface (e.g., the adjustable fin 110) along the centerline 124 may enable the movement of the adjustable fin 110 induced by the apparatus 100 to create corrective forces without creating yaw on the boat 50. The adjustable fin 110 may be mounted to the hull 122 on the centerline 124 and as close as possible to the position of the tow pylon 60. Generally the rearmost fin of the adjustable fin 110 and the tracking fins 112*a*-112*b* may be located in front of or right underneath the pylon 60. The adjustable fin 110 and the tracking fins 112*a*-112*b* may be approximately the same size. In one example, the rearmost fin may be the adjustable fin 110 (e.g., the fin closest to the ski pylon 60 and the center of the boat 50).

Figure 3:
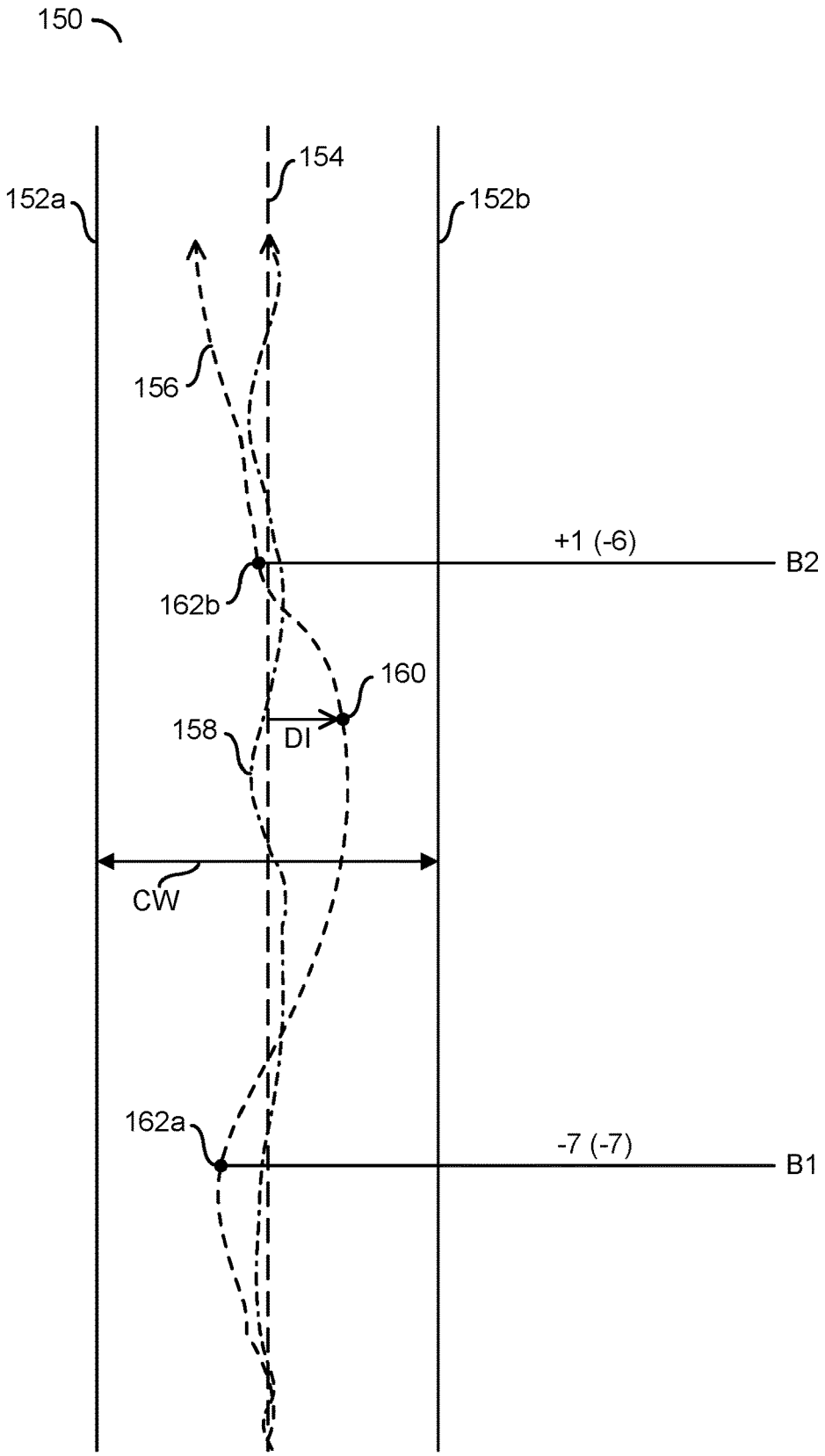
FIG. 3 is a diagram illustrating a predetermined centerline path of a boat and an actual path of a boat.

Referring to FIG. 3, a diagram illustrating a predetermined centerline path of a boat and an actual path of a boat is shown. An example portion of a water ski course 150 is shown. The example portion of a water ski course 150 may be used for a slalom water ski run. While an example of a slalom event is shown, the apparatus 100 may be similarly used for a ski jump event.

The example portion of a water ski course 150 may comprise two parallel lines 152*a*-152*b*. The two parallel lines 152*a*-152*b* may represent deviation boundaries for the boat 50. For example, if the centerline 124 of the boat 50 crosses either of the boundaries 152*a*-152*b*, then the driver of the boat 50 may have improperly pulled the skier through the water ski course. The driver of the boat 50 may attempt to pull the water skier across the course while keeping the centerline 124 of the boat 50 within the boundaries 152*a*-152*b*. A distance (e.g., CW) is shown. The distance CW may represent a width between the two boundaries 152*a*-152*b*.

A dotted line 154 is shown parallel to the boundaries 152*a*-152*b*. The dotted line 154 may bisect the area in between the boundaries 152*a*-152*b* (e.g., divide the area in between the boundaries 152*a*-152*b* into two equal areas). The dotted line 154 may represent a predetermined centerline path for the boat 50. The predetermined centerline path 154 may represent an optimal and/or ideal movement path of the boat 50 through the water 52. For example, perfect steering of the boat 50 may keep the centerline 124 along the predetermined centerline path 154 for the entire ski run (e.g., an impossible feat for a human driver). The predetermined centerline path 154 may represent a portion of the defined path for the boat 50 between two points (e.g., the start and the end of the water ski course, not shown).

The RTK GPS technology implemented by the satellite 54 and the apparatus 100 may be used to track the location of the boat 50 through the water ski course relative to the predetermined centerline path 154. The RTK GPS technology may enable the predetermined centerline path 154 to be defined (e.g., in geographical space in the water 52) in real time and to a high degree of accuracy (e.g., approximately +/−2 cm).

A dashed arrow 156 is shown. The dashed arrow 156 may represent an actual path of the boat 50. The dashed arrow 156 may represent a direction of travel of the boat 50 along the predetermined centerline path 154. For example, the GPS/GNSS signals may be interpreted by the apparatus 100 to determine the actual path 156 of the boat 50. The actual path 156 may run along the predetermined centerline path 154. Due to errors by the driver of the boat 50 and/or various forces acting on the boat (e.g., wind, currents, forces created by the water skier, etc.), the actual path 156 may deviate to the left or right of the predetermined centerline path 154. While the actual path 156 is shown deviating from the predetermined centerline path 154, the actual path 156 may remain within the boundaries 152*a*-152*b*. In the example shown, the actual path 156 may represent an example of the path of the boat 50 without applying the corrective forces calculated by the apparatus 100.

An arrow 158 is shown. The arrow 158 may represent a corrected path of the boat 50. The corrected path 158 may represent an example of the path of the boat 50 (e.g., measured using the signals from the satellite 54) with the corrective forces calculated by the apparatus 100 applied. In the example shown, the corrected path 158 may also deviate from the predetermined centerline path 154. The corrective forces generated by the adjustable fin 110 in response to the apparatus 100 may result in the corrected path 158 deviating from the predetermined centerline path 154 less than the actual path 156.

A location 160 is shown. The location 160 may illustrate a location on the actual path 156. A distance (e.g., DI) between the predetermined centerline path 154 and the location 160 of the actual path 156 may be a deviation from ideal. The deviation from ideal DI may be a comparison of the actual path 156 to the predetermined centerline path 154. The processor 102 may be configured to determine the deviation from ideal DI in order to determine the amount of corrective forces to create by moving the adjustable fin 110 in order to reduce the deviation from ideal DI. By determining the deviation from ideal DI, the processor 102 may generate a control signal to cause the actuator 104 to move the adjustable fin 110 to create the corrective forces. The corrective forces may cause the boat 50 to move closer to the predetermined centerline path 154 (e.g., without creating yaw) to enable the actual path 156 to more accurately track the predetermined centerline path 154, similar to the corrected path 158.

Locations 162*a*-162*b* are shown on the actual path 156. The location 162*a* may represent the calculated location of the centerline 124 of the boat 50 when the skier reaches a buoy (e.g., B1). In some embodiments, the apparatus 100 may calculate a deviation score for the buoy B1. In the example shown, the deviation score at the location 162*a* may be −7 (−7). A negative score may represent a deviation away from the turn or ski buoy, which may be on the right of the predetermined centerline path 154 (e.g., the actual path 156 may be approximately 7 cm to the left of the predetermined centerline path 154 at the buoy B1). The apparatus 100 may further track a cumulative deviation. Since the buoy B1 may be a first buoy, the cumulative score and the deviation may be the same value.

The location 162*b* may represent the calculated location of the centerline 124 of the boat 50 when the skier reaches a buoy (B2). In the example shown, the deviation score at the location 162*b* may be +1 (−6). A positive score may represent a deviation towards the turn or ski buoy, which may be on the left of the predetermined centerline path 154 (e.g., the actual path 156 may be approximately 1 cm to the left of the predetermined centerline path 154 at the buoy B2). The cumulative score may add the deviation score from the buoy B2 to the sum of the previous scores. Generally, a higher positive cumulative score is a greater advantage to the water skier and a higher negative cumulative score is a greater disadvantage to the water skier. A cumulative score greater than a particular amount for a course may prevent a ski run from being allowed and recorded.

In some embodiments, the apparatus 100 may be configured to determine a longitudinal position of the boat 50 relative to the skier turn buoys. The longitudinal position of the boat 50 may be determined using the information from the satellite 54. In some embodiments, the apparatus 100 may store information about the water ski course 150. The information about the water ski course 150 may comprise longitudinal position information about the location of each of the skier turn buoys. The processor 102 may be configured to compare the longitudinal position of the boat 50 with the location of each of the skier turn buoys on the water ski course 150. When the longitudinal position of the boat 50 indicates that the boat 50 is approaching one of the water skier turn buoys, the processor 102 may predict an amount of lateral force that the water skier may apply to the boat 50. The processor 102 may determine an amount of a corrective force to create using the control surface 110 in order to correct an amount of movement that may occur in response to the lateral forces applied on the boat 50 by the skier as the skier moves for the turn buoy.

The apparatus 100 may be configured to quickly counteract lateral forces exerted by the skier on the boat 50 at substantially the same point along the length of the boat 50. As the skier skis away from the turn buoys, lateral forces may be exerted on the boat 50. The apparatus 100 may be configured to compare the actual path 156 to the predetermined centerline path 154 to determine how much correction to apply. The apparatus 100 may move the adjustable fin 110 to aid the driver of the boat 50 (or take over control from the driver of the boat 50) in order to reduce the deviation from ideal. For example, by applying the corrective forces, the deviation scores may be reduced compared to when the corrective forces are not applied.

The apparatus 100 may be configured to track the position of the boat 50 within a boat lane (e.g., the boundaries 152*a*-152*b*) of a slalom and/or jump course, accurately and in real time. The actual path 156 of the boat 50 may be used to determine the amount of corrective forces to apply. Once the main anchor points of the course have been surveyed (e.g., entrance and exit gates for slalom, STs and MTs/ETs for a jump event), the apparatus 100 may determine the distances from ideal DI (e.g., axial and longitudinal) for each buoy as the buoy is surveyed.

Figure 4:
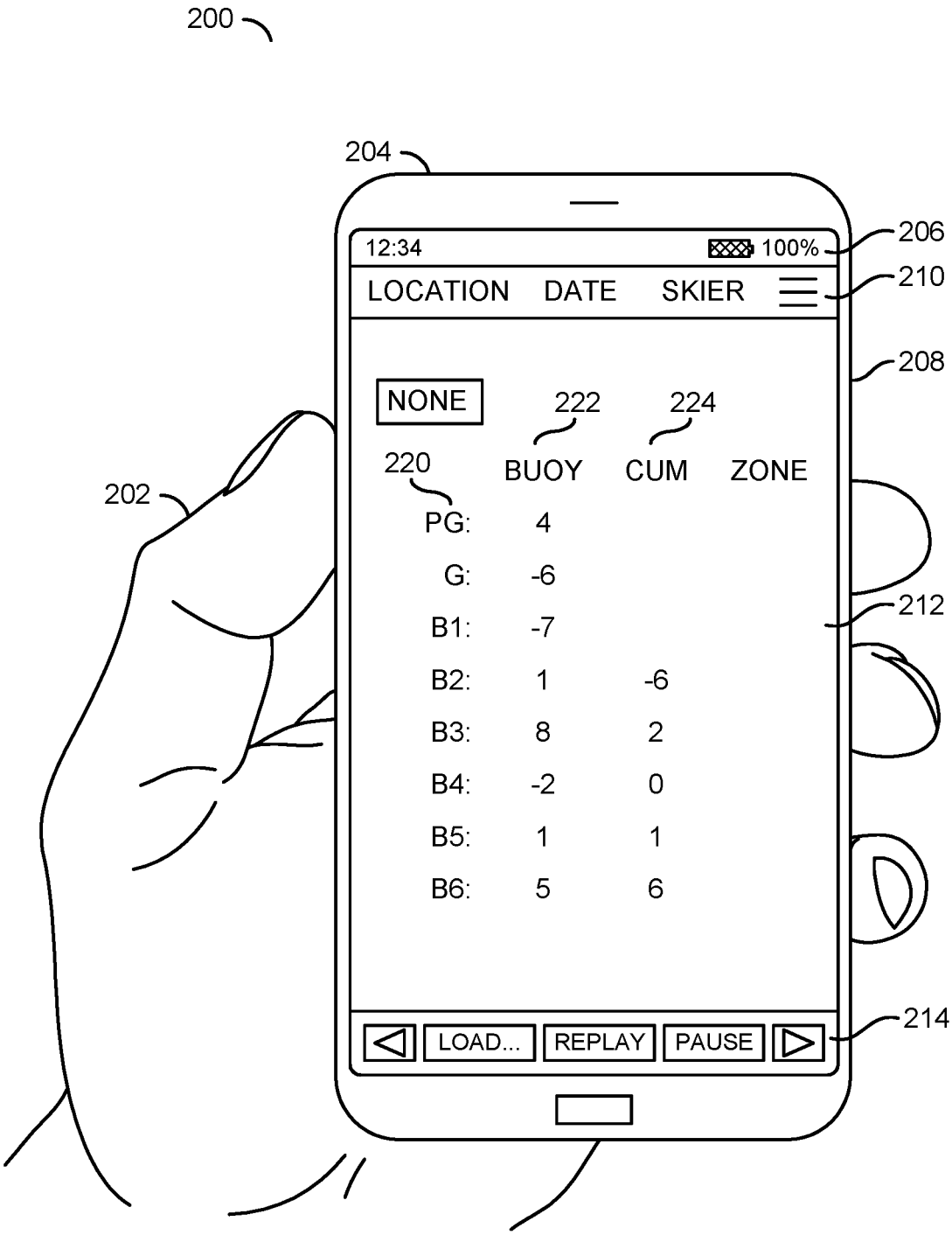
FIG. 4 is a diagram illustrating example results of a boat traveling the predetermined centerline path for a water skiing run.

Referring to FIG. 4, a diagram illustrating example results of a boat traveling the predetermined centerline path for a water skiing run is shown. Example results 200 are shown. The example results 200 may illustrate a user 202 holding a user device 204. In the example shown, the user device 204 may be a smartphone. The smartphone may be a representative example of the user device 204. The results 200 may be displayed on various types of user devices. For example, the user device 204 may be a smartphone, a feature phone, a tablet, a phablet, a desktop computer, a laptop/notebook computer, a netbook (e.g., a Chromebook), a smartwatch, etc. The type of the user device 204 implemented may be varied according to the design criteria of a particular implementation.

The smartphone 204 is shown comprising a speaker, a microphone and/or a display (e.g., a touchscreen display) in order to provide output to and/or receive input from the user 202. The smartphone 204 is shown displaying operating system standard data 206 and/or a companion application 208. The operating system standard data 206 may comprise a time, a battery capacity, a network, a connection speed, etc. The operating system standard data 206 may be information and/or graphical decorations provided by the operating system (e.g., Windows, Mac OS X, Linux, Android, Chrome OS, iOS, etc.) of the user device 204.

The companion app 208 may present output and/or receive input (e.g., touch input) via the display of the user device 204. The companion app 208 may be configured to enable the user 202 to customize various settings, access a cloud-accessible account, receive location information from the satellite 54, view results of a water ski pass and/or store results from previous water ski pass. The various features provided by the companion app 208 may be varied according to the design criteria of a particular implementation.

The companion app 208 may comprise pass info 210, results output 212 and/or controls 214. The pass info 210 may comprise a location of a water ski pass currently being viewed, a date and time of the water ski pass currently being viewed, a name of the skier and/or an options menu comprising various settings. The results output 212 may comprise a table providing the deviations from each buoy for the currently viewed water ski pass. The controls 214 may comprise various input options (e.g., load a particular water ski pass, replay a particular water ski pass, pause a particular water ski pass, etc.).

Immediately after a water ski pass, the apparatus 100 may be configured to provide information to the companion app 208. The companion app 208 may display the results output 212 showing deviations of the boat 50 when the skier is at each buoy together with the cumulative deviations. The companion app 208 may provide instant readouts of deviations of the boat 50 throughout the course in an easily scrollable graphical display. The results output 212 at the end of every pass may further provide timing and deviation readings at each buoy together with cumulative deviations. In an example, a border displayed for the results output 212 may have a color to provide an "at-a-glance" indication of whether the pass was "in tolerance" (green), "optional re-ride" (amber) or "mandatory re-ride" (red).

The results output 212 may comprise a table with columns 220-224. The column 220 may display each buoy (e.g., pre-gate (PG), a gate (G), and multiple buoys for the ski pass (e.g., B1-B6)). The column 222 may display a measured deviation corresponding to each of the buoys (e.g., a measurement of the actual path 156 compared to the predetermined centerline path 154). In an example, positive deviations may indicate that the actual path 156 of the boat 50 was offset from the predetermined centerline path 154 towards the buoy (e.g., to the right when the buoy is on the right side of the boat 50 and to the left when the buoy is on the left side of the boat 50) and negative deviations may indicate that the actual path 156 of the boat 50 was offset from the predetermined centerline path 154 away from the buoy (e.g., to the left when the buoy is on the right side of the boat 50 and to the right when the buoy is on the left side of the boat 50). The column 224 may provide a cumulative deviation score. The cumulative deviation score may add all the previous deviations. Generally, a good run may have a cumulative score under 20.

In the example shown, the results output 212 may provide the deviation scores for the water ski pass example 150 shown in association with FIG. 3. For example, the buoy deviation column 222 for the buoy B1 may indicate a deviation of −7 and since B1 is the first buoy no cumulative score may be indicated. Continuing the example, the buoy deviation column 222 for the buoy B2 may indicate a deviation of +1 and the cumulative score column 225 may indicate a cumulative score of −6 (e.g., −7 from B1 plus +1 from B2). The results output 212 may further display the deviations and cumulative score for the rest of the buoys B3-B6 in the water ski pass.

The deviation column 222 may indicate the actual path 156 compared to the predetermined centerline path 154 measured at the buoys B1-B6. The apparatus 100 may be configured to compare the actual path 156 to the predetermined centerline path 154 through the entire water ski pass (e.g., in between the buoys as well as at the buoys). By measuring the deviations and the direction of the deviations from the predetermined centerline path 154, the apparatus 100 may be configured to provide the corrections (e.g., microcorrections) using the control surface 110. The corrections may be applied to the boat 50 during the water ski pass. When the apparatus 100 performs the corrections, the deviations measured in the deviation column 222 may be smaller (e.g., closer to zero) and the cumulative deviation 224 may be reduced.

The output results 212 shown for the companion app 208 on the user device 204 may be a representative example. The output results 212 of the companion app 208 may change as official rules are changed for various water ski events. Generally, the user device 204 that executes the companion app 208 may be one example of a device configured to calculate the deviation from ideal value DI. The processor 102 may be configured to determine a value for the correctional forces in response to the deviation from ideal value DI and present the control signal to the actuator 104 to adjust the control surface 110. The display of the output results 212 and/or determination of the deviation from ideal value DI may be varied according to the design criteria of a particular implementation.

Figure 5:
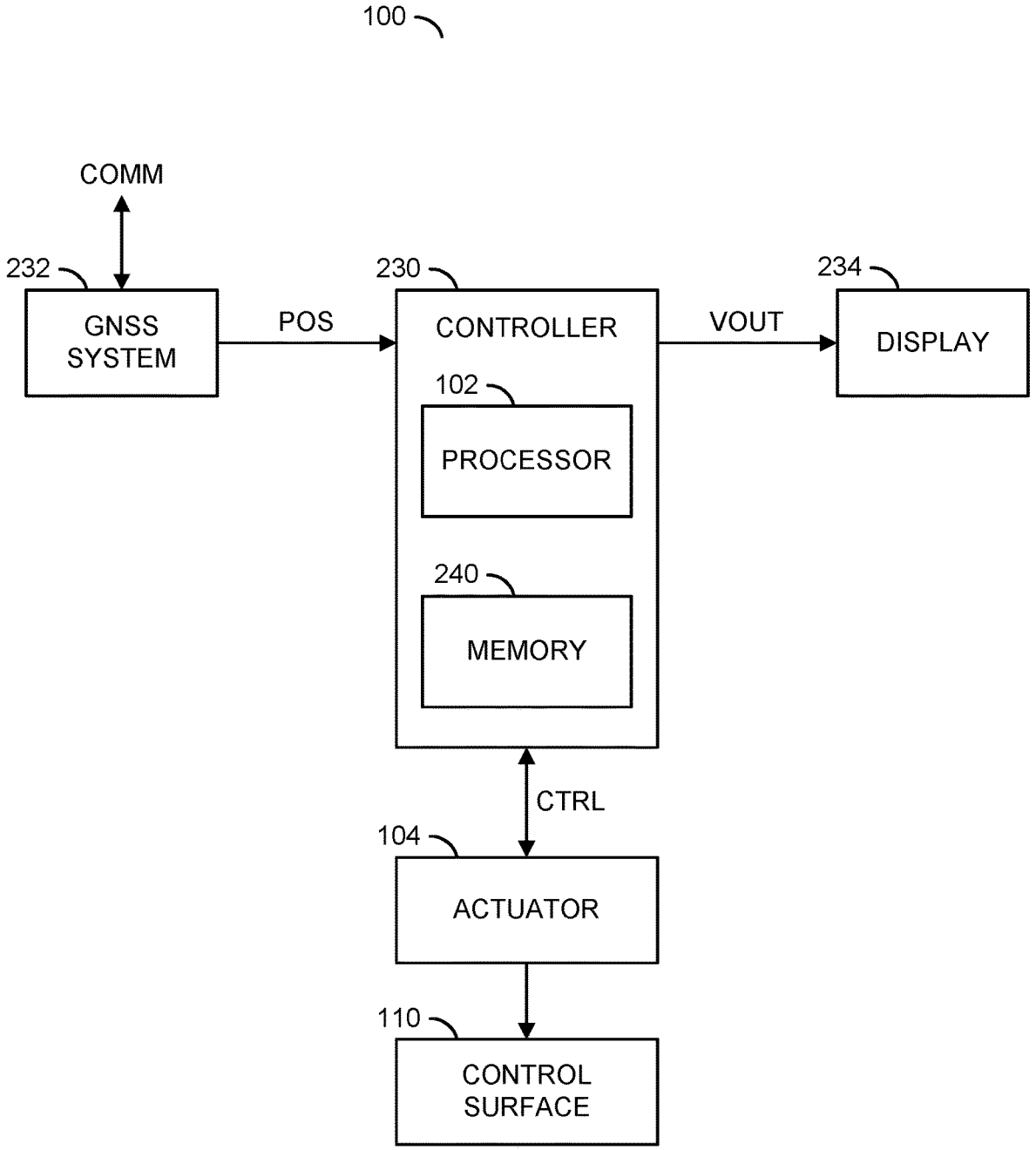
FIG. 5 is a block diagram illustrating an example embodiment of the present invention.

Referring to FIG. 5, a block diagram illustrating an example embodiment of the present invention is shown. The apparatus 100 is shown. The apparatus 100 may comprise the actuator 104, the control surface 110, a block (or circuit) 230, a block (or circuit) 232 and/or a block (or circuit) 234. The circuit 230 may implement a controller. The circuit 232 may implement a GNSS system. The circuit 234 may implement a display. The apparatus 100 may comprise other components (not shown). In some embodiments, the GNSS system 232 and/or the display 234 may be optional components of the apparatus 100. The number, type and/or arrangement of the components of the apparatus 100 may be varied according to the design criteria of a particular implementation.

The GNSS system 232 may be configured to calculate the actual path 156 of the boat 50. In some embodiments, the calculations performed by the GNSS system 232 may be performed by a component separate from the apparatus 100 (e.g., an external component that may provide the calculated results to the apparatus 100). In some embodiments, the calculations performed by the GNSS system 232 may be performed by the processor 102 (e.g., no additional component such as the GNSS system 232 may be implemented).

The GNSS system 232 may be configured to receive a signal (e.g., COMM) and present a signal (e.g., POS). The signal COMM may be the signal(s) communicated from the satellite 54. The GNSS system 232 may be configured to receive the signal COMM, and perform calculations to determine the location of the boat 50 relative to the base beacon. The signal POS may comprise the actual geographic location of the boat 50. The signal POS may be presented to the controller 230.

The controller 230 may comprise the processor 102 and/or a block (or circuit) 240. The circuit 240 may implement a memory. The controller 230 may comprise other components (not shown). For example, the controller 230 may comprise input/output connectors and/or transceivers to enable the controller 230 to communicate with the GNSS system 232 and/or the display 234 (e.g., an HDMI output, a DVI output, a USB output, a Wi-Fi connection, a Bluetooth connection, etc.). The number, type and/or arrangement of the components of the controller 230 may be varied according to the design criteria of a particular implementation.

The controller 230 may be configured to receive the signal POS. The controller 230 may be configured to generate a signal (e.g., VOUT). The controller 230 may be configured to communicate a signal (e.g., CTRL) with the actuator 104. The signal VOUT may be a video output to the display 234. The signal CTRL may be a control signal.

The display 234 may be configured to provide visual output. In an example, the display 234 may be an example of the user device 204. For example, the display 234 may be a monitor built into the boat 50 configured to display the companion app 208. In an example, the signal VOUT may comprise the output results providing the deviations of the actual path 156 from the predetermined centerline path 154.

The processor 102 may be configured to execute computer readable instructions. The processor 102 may be a general purpose microprocessor configured to perform calculations and/or comparisons for various features. In an example, the processor 102 may be configured to perform the calculations to determine the actual geographic location from the signal COMM (e.g., in implementations where the GNSS system 232 is not implemented as a separate component). In another example, the processor 102 may be configured to generate video output for the display 234. In yet another example the processor 102 may be configured to provide navigation for the boat 50, adjust various quality of life settings in the boat 50, perform cruise control, receive input to control the rudder 62, receive input to control the propeller 64, etc. The functionality of the processor 102 may be varied according to the design criteria of a particular implementation.

The processor 102 may be configured to read the signal POS. In response to the signal POS, the processor 102 may determine the actual path 156 of the boat 50. For example, the actual path 156 of the boat 50 may comprise a history of the actual location of the boat 50 received from the signal POS, plotted over time. The processor 102 may compare the actual path 156 with the predetermined centerline path 154. The processor 102 may be configured to generate the control signal CTRL in response to the comparison of the actual path 156 with the predetermined centerline path 154.

The memory 240 may be configured to store data. The memory 240 may comprise random access memory and/or read-only memory. The memory 240 may comprise volatile and/or non-volatile memory. In an example, the memory 240 may be configured to store the results from ski passes in non-volatile memory. In another example, the memory 240 may store the predetermined centerline path 154 for the water ski passes (e.g., the geographic location of the centerline path for a particular water ski course). In yet another example, the memory 240 may comprise data corresponding to expected forces applied by a water skier at particular locations of a water ski course. The type and/or capacity of the memory 240 may be varied according to the design criteria of a particular implementation.

The memory 240 may be configured to store computer readable instructions. The computer readable instructions from the memory 240 may be executed by the processor 102. The computer readable instructions, when executed by the processor 102 may perform a number of steps. In an example, one of the steps of the computer readable instructions executed by the processor 102 may comprise calculating the actual position and/or the actual path 156 of the boat 50 in response to the signal COMM received from the satellite 54 and/or from the signal POS. In another example, one of the steps of the computer readable instructions executed by the processor 102 may comprise comparing the actual position and/or the actual path 156 of the boat 50 with respect to the predetermined centerline path 154 of the boat 50. In yet another example, one of the steps of the computer readable instructions executed by the processor 102 may comprise determining a current orientation of the control surface 110. The current orientation of the control surface 110 may be used to determine how much to change the control surface 110 to perform the correction without inducing yaw. In still another example, one of the steps of the computer readable instructions executed by the processor 102 may comprise calculating corrective lateral forces to adjust the actual path 156 of the boat 50 relative to the predetermined centerline path 154. In an example, one of the steps of the computer readable instructions executed by the processor 102 may comprise generating the control signal CTRL to adjust the current orientation of the control surface 110 to a position that provides the corrective lateral forces.

The processor 102 may present the signal CTRL to the actuator 104. In one example, the actuator 104 may comprise a servo motor that may be positionally controlled by the signal CTRL. The actuator 104 may comprise a mechanical linkage assembly to attach the control surface 110. The control signal CTRL may control the actuator 104 in order to adjust a position of the control surface 110. In one example, the actuator 104 may comprise a DC servo motor mounted directly on top of a spindle that drives the adjustable fin (e.g., the control surface 110).

The processor 102 may generate the control signal CTRL, which may comprise calculating a numerical value (e.g., a voltage). The numerical value calculated by the processor 102 for the signal CTRL may determine an amount of adjustment to the control surface 110 by the actuator 104. For example, the calculation of the control signal CTRL may comprise translating a desired amount of movement of the control surface 110 to a numerical value for a parameter that causes the actuator 104 to create the desired amount of movement. The desired amounts of movement may comprise the corrections calculated by the processor 102.

In one example, the processor 102 may generate the control signal CTRL to perform reactive corrections. The reactive corrections may respond to deviations measured away from the centerline. The correctional response for the relative corrections may be calculated by the processor 102 using a formula based on one input (e.g., the deviations of the actual path 156 from the predetermined centerline path 154).

In another example, the processor 102 may generate the control signal CTRL to perform anticipated corrections. The anticipated corrections may respond to the deviations away from the centerline and an expected force on the boat 50 caused by the skier. The anticipated corrections may react similar to a skilled boat driver (e.g., by knowing the position along the length of the course based on the actual position 156 and the predetermined centerline path 154 and applying corrections in anticipation of the skier pulling at certain places along the course based on the location of the buoys). The correctional response for the anticipated corrections may be calculated by the processor 102 using a formula based on two inputs (e.g., the deviations of the actual path 156 from the predetermined centerline path 154 and a position of the boat 50 along the length of the course). The memory 240 may comprise a lookup table comprising averaged correction data.

Generally, the control signal CTRL may be generated such that increased deviation of the boat 50 from the predetermined centerline path 154 results in increased correction forces from the control surface 110 (e.g., the adjustable fin 110). In one example, the processor 102 may calculate the amount of corrective force as a linear relationship with the amount of deviation of the actual path 156 from the predetermined path 154. In another example, the processor 102 may calculate the amount of corrective force as a logarithmic curve with respect to the amount of deviation. The corrective forces calculated by the processor 102 may be further modified in response to a size and/or type of the control surface 110 (e.g., alternate implementations of adjustable fin(s)). The corrective forces calculated by the processor 102 may be further modified in response to a weight of the skier and/or a style of the skier (e.g., how aggressively the skier pulls out of the buoy, which may be stored as historical data about a particular skier in the memory 240). The calculations performed and/or the factors applied by the processor 102 for generating the signal CTRL may be varied according to the design criteria of a particular implementation.

The corrections to the movement of the boat 50 applied in response to the control signal CTRL may be performed without inducing yaw. To prevent yaw from being induced, the control signal CTRL may be presented to the actuator 104 configured to control the adjustable fin 110. The adjustable fin 110 (e.g., a corrective surface) and/or combinations of control surfaces may be suitably placed on the boat 50 to prevent the yaw.

Figure 6:
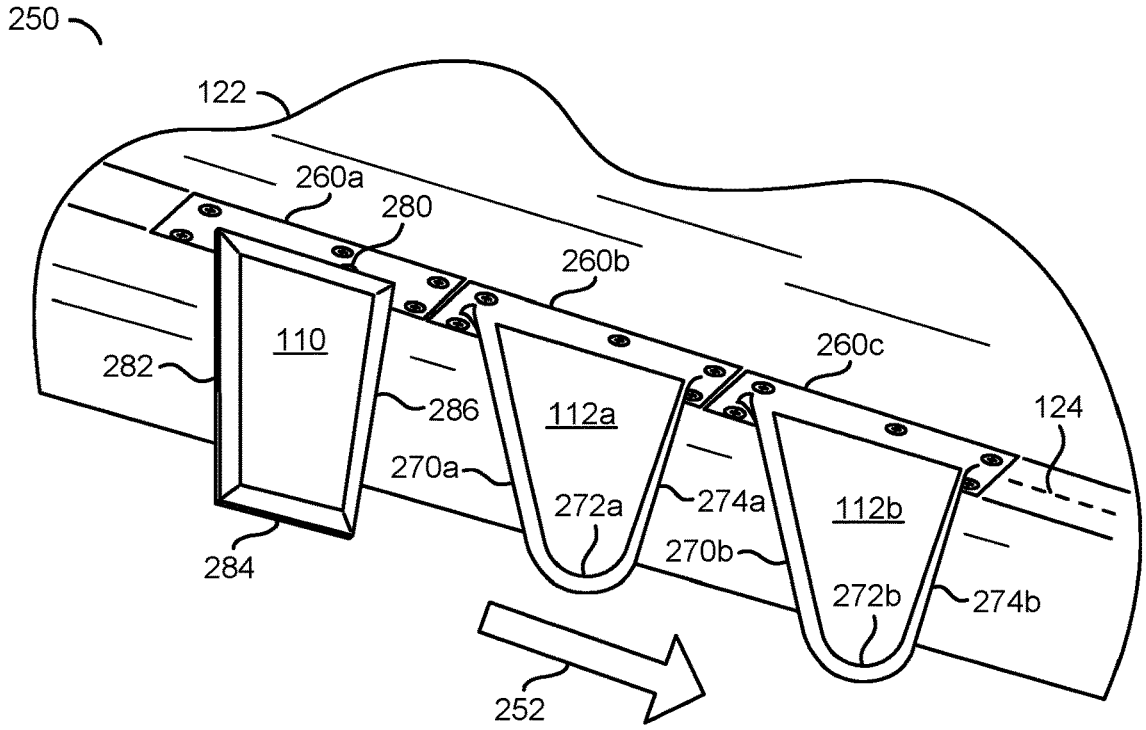
FIG. 6 is a diagram illustrating an example embodiment of a fin mounted on a centerline of a boat controlled by an actuator to move the boat laterally without inducing yaw.

Referring to FIG. 6, a diagram illustrating an example embodiment of a fin mounted on a centerline of a boat controlled by an actuator to move the boat laterally without inducing yaw is shown. A view 250 is shown. The view 250 may comprise a portion of the hull 122 of the boat 50. An arrow 252 is shown. The arrow 252 may illustrate a direction of the travel of the boat 50 for the view 250. The arrow 252 may be pointed towards the front end of the boat 50. The adjustable fin 110 and the tracking fins 112*a*-112*b* are shown connected to the hull 122.

Connectors 260*a*-260*c* are shown. The connectors 260*a*-260*c* may be configured to attach and hold the adjustable fin 110 and the tracking fins 112*a*-112*b* to the hull 122 of the boat 50. In the example shown, the connector 260*a* may securely attach to the adjustable fin 110, the connector 260*b* may securely attach to the tracking fin 112*a*, and the connector 260*c* may securely attach to the tracking fin 112*b*. In the example shown, the connectors 260*a*-260*c* may be attached to the hull 122 along the centerline 124. The tracking fins 112*a*-112*b* may each comprise a respective one of trailing edges 270*a*-270*b*, bottom edges 272*a*-272*b* and leading edges 274*a*-274*b*. A top edge of the tracking fin 112*a* may be formed to the connector 260*b* and a top edge of the tracking fin 112*b* may be formed to the connector 260*c*. The trailing edges 270*a*-270*b* may extend from the connectors 260*b*-260*c* at an angle. The trailing edges 270*a*-270*b* may extend to the bottom edges 272*a*-272*b*. The bottom edges 272*a*-272*b* may have a rounded shape. The bottom edges 272*a*-272*b* may be rounded from the trailing edges 270*a*-270*b* to the leading edges 274*a*-274*b*. The leading edges 274*a*-274*b* may extend generally straight down from the connectors 260*b*-260*c*. In the example shown, the leading edges 274*a*-274*b* may extend perpendicularly from the connectors 260*b*-260*c*. However, the shape of the leading edges 274*a*-274*b* may be implemented at an angle with respect to the connectors 260*b*-260*c*.

The control surface 110 may be connected to the connector 260*a* via a pivot 280. The pivot 280 may be controlled by the actuator 104. In an example, the actuator 104 may rotate the pivot 280 in response to the signal CTRL generated by the processor 102. The pivot 280 may be connected to a top edge of the adjustable fin 110. The pivot 280 may be attached to the connector 260*a* along the centerline 124 of the hull 122. The pivot 280 may provide a secure attachment to the connector 260*a*, while enabling the adjustable fin 110 to rotate. The rotation of the adjustable fin 110 by the pivot 280 may provide the corrective forces without inducing yaw.

The adjustable fin 110 may have a different shape than the tracking fins 112*a*-112*b*. The adjustable fin 110 may comprise a trailing edge 282, a bottom edge 284 and a leading edge 286. The trailing edge 282 may extend from the top edge (e.g., not directly connected to the connector 260*a*) at an angle. The trailing edge 282 may extend to the bottom edge 284. The bottom edge 284 may have a flat shape. For example, the bottom edge 284 may run parallel to the connector 260*a* along the centerline 124. The bottom edge 284 may extend from the trailing edge 282 to the leading edge 286. The leading edge 286 may extend generally straight down from the connector 260*a* (e.g., not directly connected to the connector 260*a*). In an example, the leading edge 286 may extend perpendicularly from the connector 260*a*. A gap may be present between the top edge of the adjustable fin 110 and the connector 260*a*. The pivot 280 may extend from the connector 260*a* to the top edge of the adjustable fin 110 through the gap.

The control surface 110 may be positioned close enough to the longitudinal centerline 124 of the boat 50 such that the lateral forces experienced by the boat 50 do not induce a significant amount of yaw. By providing movement without inducing yaw, the rotation of the pivot 280 may move the angle of the control surface 110 in order to move the boat 50 sideways (e.g., towards the predetermined centerline path 154) while maintaining a constant attitude.

The corrective forces created by the movement of the control surface 110 may be used to counteract forces that may cause the boat 50 to deviate from the predetermined centerline path 154 with a bearing aligned with the predetermined centerline path 154. For example, lateral forces applied to the ski pylon 60 by the skier may force the boat away from the predetermined centerline path 154, which may be counteracted by the forces created by the control surface 110. Generally, the control surface 110 may be located on the centerline 124 of the boat 50 as near as possible to the ski pylon 60.

In the example shown, the control surface 110 is shown as a single adjustable fin. The apparatus 100 may be configured to adjust other types of control surfaces and/or more than one control surface. The control surface 110 may be any moveable surface that, when moved, alters the flow of the water 52 such that the boat 50 experiences a force that has a component perpendicular to the direction of travel 252.

Figure 7:
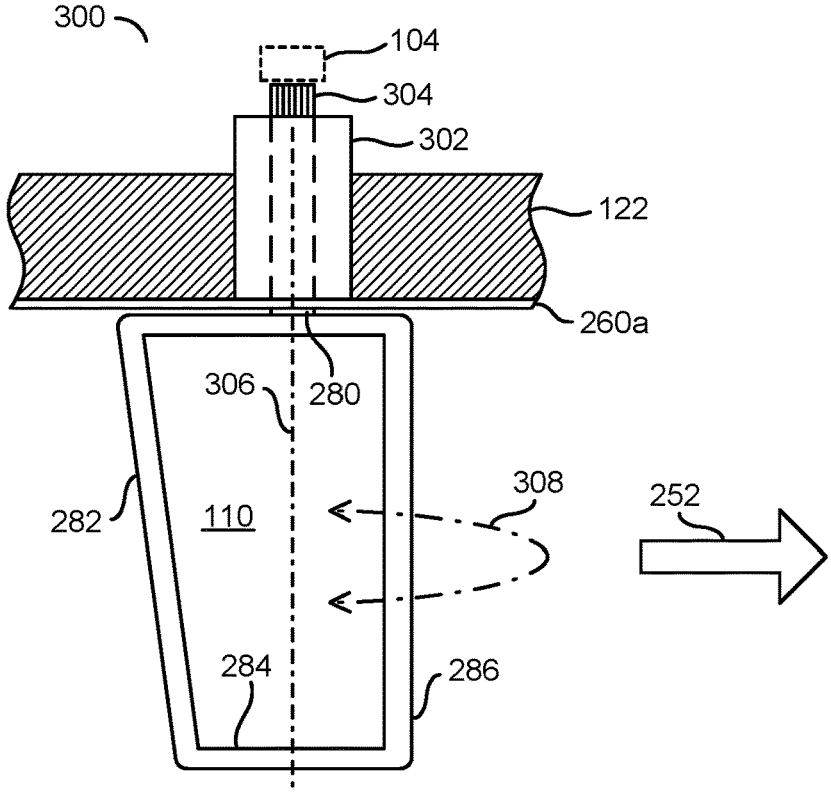
FIG. 7 is a diagram illustrating a rotatable fin assembly.

Referring to FIG. 7, a diagram illustrating a rotatable fin assembly is shown. A view 300 is shown. The view 300 may comprise a portion of the hull 122 of the boat 50. A cutaway view of the hull 122 is shown in the view 300. The connector 260*a* is shown attached to the hull 122. The direction of travel 252 is shown.

A pipe 302 and a splined shaft 304 are shown. The pipe 302 may extend from within the boat 50 and through the hull 122. The pipe 302 may provide a sealed passage through the hull 122 for the pivot 280 and/or the splined shaft 304. The pipe 302 may enable the actuator 104 to rotate the pivot 280 while preventing water from entering the boat 50.

The splined shaft 304 may extend through the pipe 302 to the pivot 280. The actuator 104 is shown within the boat 50. The location of the actuator 104 shown may be an illustrative example to show the relationship between the actuator 104 and the splined shaft 304. The actuator 104 may be configured to rotate the splined shaft 304 and hence rotate the pivot 280. The actuator 104 may be configured to move the entire adjustable fin 110 by rotating the pivot 280 via the splined shaft 304.

The view 300 may provide a profile view of the adjustable fin 110. A gap is shown between the connector 260*a* and the adjustable fin 110. The trailing edge 282 (e.g., at an angle), the bottom edge 284 (e.g., flat and parallel to the hull 122) and the leading edge 286 (e.g., extending perpendicular from the hull 122) are shown. For example, the leading edge 286 may be vertically oriented and the trailing edge 282 may be slightly tapered as shown.

A dotted line 306 is shown. The dotted line 306 may illustrate a pivot point. The pivot point 306 may extend from the splined shaft 304, through the pipe 302, through the center of the pivot 280 and then down the adjustable fin 110. The pivot point 306 may be an axis along which the adjustable fin 110 rotates. The pivot point 306 may be closer to the leading edge 286 than the trailing edge 282. In the example shown, the pivot point 306 may be at a 2:3 ratio towards the leading edge 286.

The rudder 62 may pivot at a leading edge, which requires a large amount of input force to enable rotation. The control surface 110 may be implemented with the pivot point 306 away from the leading edge 286 and may provide a positive feedback. For example, as the adjustable fin 110 is rotated, the water 52 impacting the fin area in front of the pivot point 306 may aid in the turning of the adjustable fin 110. A net force needed to turn the adjustable fin 110 may be a difference between a front force and the force of the water 52 on the area of the adjustable fin 110 to the rear of the pivot point 306. By connecting the pivot 280 at the pivot point 306 (e.g., closer to the center between the leading edge 286 and the trailing edge 282) the actuator 104 implemented as a relatively small servo motor may be sufficient to drive the adjustable fin 110.

In some embodiments, the pivot point 306 may be located at the front of the adjustable fin 110. In some embodiments, the pivot point 306 may be located one third of the length of the adjustable fin 110 back from the leading edge 286. The size and/or power of the actuator 104 may be adjusted based on the location of the pivot point 306. The location of the pivot point 306 and/or the size/power of the actuator 104 may be varied according to the design criteria of a particular implementation.

A curved, double-ended arrow 308 is shown. The curved, double-ended arrow 308 may wrap around the leading edge 286 of the adjustable fin 110. The curved, doubled-ended arrow may illustrate a rotation of the adjustable fin 110. By rotating the pivot 280, the adjustable fin 110 may be angled with the leading edge 286 to the right (e.g., towards the perspective shown) and cause the trailing edge 282 to angle to the left, or the adjustable fin 110 may be angled with the leading edge 286 to the left (e.g., away from the perspective shown) and cause the trailing edge 282 to angle to the right.

Figure 8:
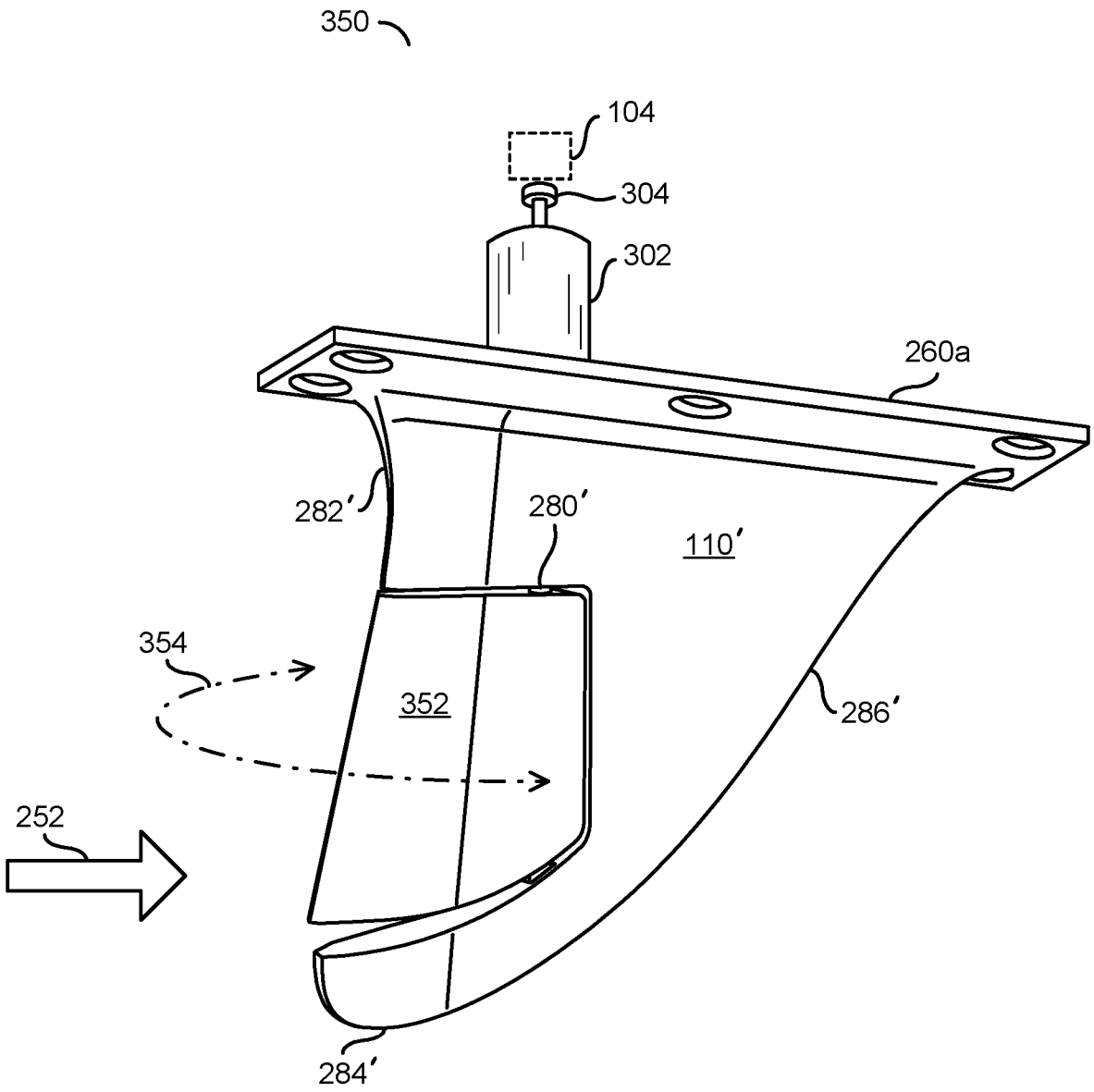
FIG. 8 is a diagram illustrating an example embodiment of a fixed fin with a trim tab mounted on a centerline of a boat controlled by an actuator to move the boat laterally without inducing yaw.

Referring to FIG. 8, a diagram illustrating an example embodiment of a fixed fin with a trim tab mounted on a centerline of a boat controlled by an actuator to move the boat laterally without inducing yaw is shown. A view 350 is shown. The view 350 may comprise the connector 260*a* and the control surface 110'. The connector 260*a* is shown formed to the control surface 110' as a single component. The direction of travel 252 is shown.

The actuator 104 and the splined shaft 304 are shown. The splined shaft 304 is shown extending from the pipe 302. The actuator 104 may be configured to rotate the pivot 280' via the splined shaft 304. The pipe 302 may provide a sealed passage through the hull 122 for the pivot 280' and/or the splined shaft 304. The pipe 302 may enable the actuator 104 to rotate the pivot 280' while preventing water from entering the boat 50. The pivot 280' may extend through the control surface 110'. In the example shown, there may not be a gap between the top edge of the control surface 110' and the connector 260*a* (e.g., since the top edge of the control surface 110' is attached to the connector 260*a*, the pivot 280' may not provide the attachment between the connector 260*a* and the adjustable fin 110 as shown in association with FIG. 7).

The control surface 110' may be implemented as a static fin. For example, the control surface 110' may be formed to the connector 260*a*, which may not allow the entire body of the control surface 110' to rotate. The control surface 110' may comprise the trailing edge 282', the bottom edge 284' and the leading edge 286'. The leading edge 286' may extend from the connector 260*a* at an angle (e.g., an acute angle with respect to the connector 260*a*). The leading edge 286' may extend to the bottom edge 284'. The bottom edge 284' may have a rounded shape. The bottom edge 284' may be rounded from the leading edge 286' to the trailing edge 282'. The trailing edge 282' may extend generally straight down from the connector 260*a*. In the example shown, the trailing edge 282' maybe curved and/or angled slightly (e.g., less than the leading edge 286') away from the center of the connector 260*a*. Generally, the shape of the control surface 110' may be similar to the shape of the tracking fins 112*a*-112*b* shown in association with FIG. 6.

The control surface 110' may comprise a trim tab 352. The trim tab 352 may be a rotatable flap incorporated into the trailing edge 282'. The trim tab 352 may be located below the connector 260*a* and above the bottom edge 284'. For example, the trim tab 352 may move without the bottom edge 284' moving.

The pivot 280' may extend through the control surface 110'. The location of the pivot 280' may be off center from the connector 260*a* and the control surface 110'. In the example shown, the pivot 280' may extend approximately one third of the length of the control surface 110' from the trailing edge 282'. The pivot 280' may extend through trim tab 352. The rotation of the pivot 280' may cause the trim tab 352 to rotate. The rotation of the trim tab 352 may cause a discontinuity in the trailing edge 282'.

The actuator 104 may be configured to move the trim tab 352 of the control surface 110'. The rotation of the trim tab 352 may induce a lateral force on the boat 50. The lateral force created by the rotation of the trim tab 352 may be similar to the forces created by the rotation of the adjustable fin 110 shown in association with FIG. 7.

A curved, double-ended arrow 354 is shown. The curved, double-ended arrow 354 may wrap around the trim tab 352. The curved, doubled-ended arrow 354 may illustrate a rotation of the trim tab 352. By rotating the pivot 280', the trim tab 352 may be angled to the right of the trailing edge 282' (e.g., away from the perspective shown), or the trim tab 352 may be angled to the left of the trailing edge 282' (e.g., towards the perspective shown).

Figure 9:
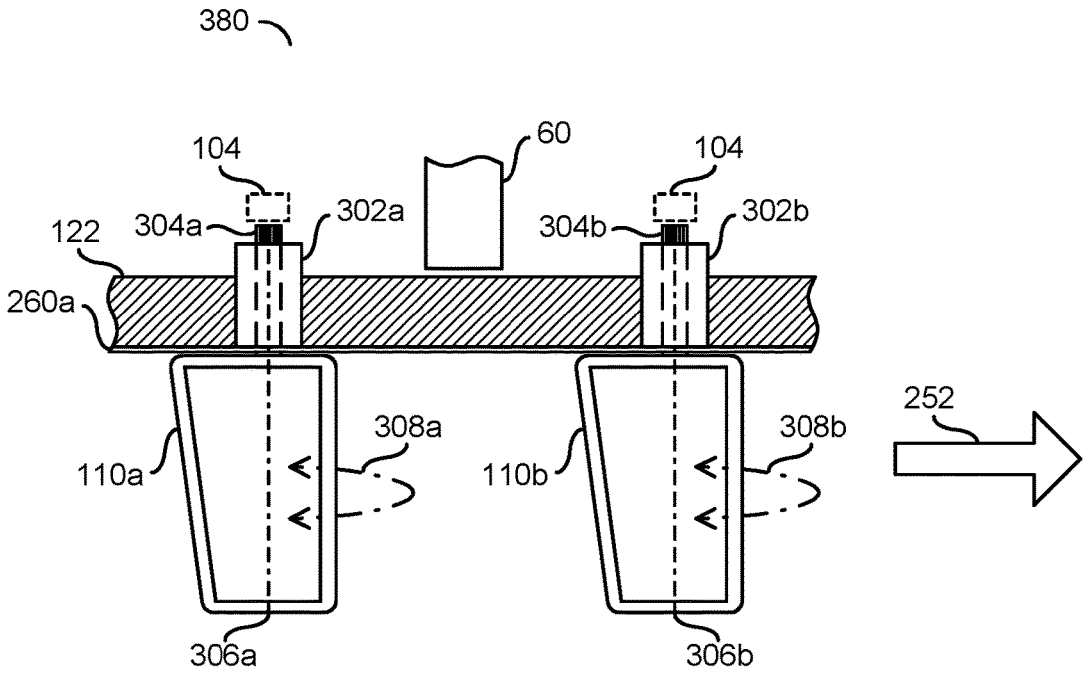
FIG. 9 is a diagram illustrating an example embodiment implementing two fins controlled by an actuator implemented in front of and to the rear of a water ski pylon.

Referring to FIG. 9, a diagram illustrating an example embodiment implementing two fins controlled by an actuator implemented in front of and to the rear of a water ski pylon is shown. A view 380 is shown. The view 380 may comprise a portion of the hull 122 of the boat 50. A cutaway view of the hull 122 is shown in the view 380. The connector 260*a* is shown attached to the hull 122. The direction of travel 252 is shown.

The view 380 may illustrate a pair of dynamically controlled fins 110*a*-110*b* acting in tandem. Each of the fins 110*a*-110*b* may be a control surface having a similar implementation as the adjustable fin 110 as described in association with FIGS. 6-7. The pipes 302*a*-302*b* may extend through the hull 122 to enable the splined shafts 304*a*-304*b* to rotate the pivots 280*a*-280*b* (not shown) to enable the rotation of the dynamically controlled fins 110*a*-110*b*, respectively. The dynamically controlled fins 110*a*-110*b* may rotate about the respective pivot points 306*a*-306*b* (e.g., the pivot points 306*a*-306*b* may be closer to the respective leading edges). The respective rotations 308*a*-308*b* may illustrate the rotation of the dynamically controlled fins 110*a*-110*b*.

The pylon 60 is shown above the hull 122. The dynamically controlled fins 110*a*-110*b* are shown implemented on either side of (e.g., in front of and to the rear of) the pylon 60. For example, the pylon 60 may be located in between the dynamically controlled fins 110*a*-110*b* along the centerline 124 of the boat 50. The dynamically controlled fin 110*b* may be mounted in front of the mount position of the pylon 60 and the other dynamically controlled fin 110*a* may be mounted rearward of the mount position of the pylon 60. The arrangement of the dynamically controlled fins 110*a*-110*b* (e.g., equal distance in front of and rear from the pylon 60) may enable the corrective forces to be generated for the boat 50 without inducing any yaw.

In the example shown, the dynamically controlled fins 110*a*-110*b* may be located close to the pylon 60. In some embodiments, the dynamically controlled fins 110*a*-110*b* may be located along the centerline 124 but with the dynamically controlled fin 110*b* much nearer to the front of the boat 50 and the dynamically controlled fin 110*a* much further back. For example, the distance between the dynamically controlled fins 110*a*-110*b* may be farther than shown (e.g., not near the pylon 60). Even with a large distance between the dynamically controlled fins 110*a*-110*b*, the apparatus 100 may provide the control that may create the desired correctional effect without inducing yaw.

The actuator 104 is shown controlling both of the dynamically controlled fins 110*a*-110*b* via the splined shafts 304*a*-304*b*, respectively. In some embodiments, the processor 102 may be configured to generate multiple control signals CTRL for more than one actuator. For example, one actuator (e.g., 104*a*) may be controlled by a control signal (e.g., CTRL_A) generated by the processor 102 to cause the rotation 308*a* of the dynamically controlled fin 110*a* and another actuator (e.g., 104*b*) may be controlled by another control signal (e.g., CTRL_B) generated by the processor 102 to cause the rotation 308*b* of the dynamically controlled fin 110*b*. In some embodiments, the processor 102 may be configured to move the dynamically controlled fins 110*a*-110*b* independently. In some embodiments, the processor 102 may be configured to move the dynamically controlled fins 110*a*-110*b* in unison. The processor 102 may be configured to operate the dynamically controlled fins 110*a*-110*b* in tandem to create the corrective forces.

Figure 10:
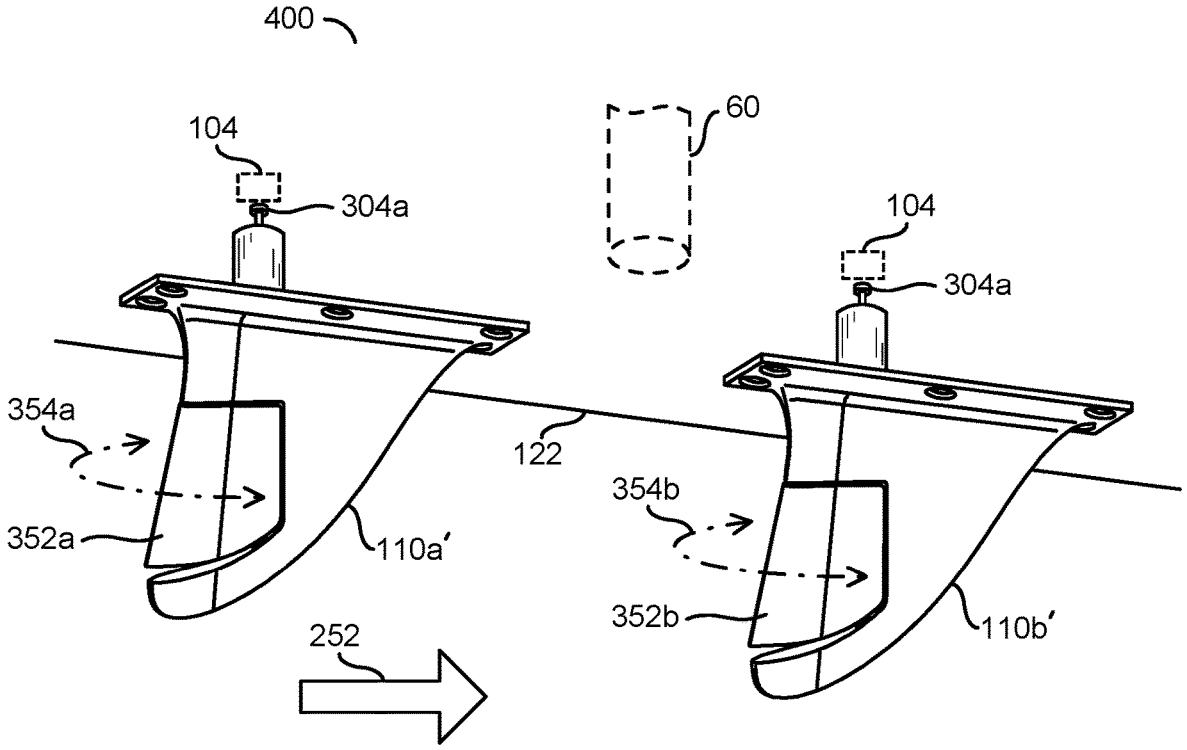
FIG. 10 is a diagram illustrating an example embodiment implementing two fins with trim tabs controlled by an actuator implemented in front of and to the rear of a water ski pylon.

Referring to FIG. 10, a diagram illustrating an example embodiment implementing two fins with trim tabs controlled by an actuator implemented in the front and rear of a water ski pylon is shown. A view 400 is shown. The view 400 may comprise a portion of the hull 122 illustrating the control surfaces 110*a*'-110*b*' attached to the hull 122. A location of the pylon 60 is shown above the hull 122. The direction of travel 252 is shown.

The view 400 may illustrate a pair of static fins with trim tabs 110*a*'-110*b*' acting in tandem. Each of the fins 110*a*'-110*b*' may be control surfaces having a similar implementation as the control surface 110' as described in association with FIG. 8. The pipes 302*a*-302*b* may extend through the hull 122 to enable the splined shafts 304*a*-304*b* to rotate the pivots 280*a*-280*b* (not shown) to enable the rotation of the trim tab fins 110*a*'-110*b*', respectively. The respective trim tabs 352*a*-352*b* of the trim tab fins 110*a*'-110*b*' may be configured to rotate. The respective rotations 354*a*-354*b* may illustrate the rotation of the trim tab fins 110*a*'-110*b*'.

The pylon 60 is shown above the hull 122. The trim tab fins 110*a*'-110*b*' are shown implemented on either side of (e.g., in front of and to the rear of) the pylon 60. For example, the pylon 60 may be located in between the trim tab fins 110*a*'-110*b*' along the centerline 124 of the boat 50. For example, the trim tab fins 110*a*'-110*b*' may be located similar to the dynamically controlled fins 110*a*-110*b* as described in association with FIG. 9. The arrangement of the trim tab fins 110*a*'-110*b*' (e.g., equal distance in front of and rear from the pylon 60) may enable the corrective forces to be generated for the boat 50 without inducing any yaw.

The actuator 104 is shown controlling both of the trim tabs 352*a*-352*b* of the respective trim tab fins 110*a*'-110*b*' via the splined shafts 304*a*-304*b*, respectively. In some embodiments, the processor 102 may be configured to generate multiple control signals CTRL for more than one actuator. For example, one actuator (e.g., 104*a*) may be controlled by a control signal (e.g., CTRL_A) generated by the processor 102 to cause the rotation 354*a* of the trim tab fin 110*a*' and another actuator (e.g., 104*b*) may be controlled by another control signal (e.g., CTRL_B) generated by the processor 102 to cause the rotation 354*b* of the trim tab fin 110*b*'. The processor 102 may be configured to operate the trim tab fins 110*a*'-110*b*' in tandem to create the corrective forces.

Figure 11:
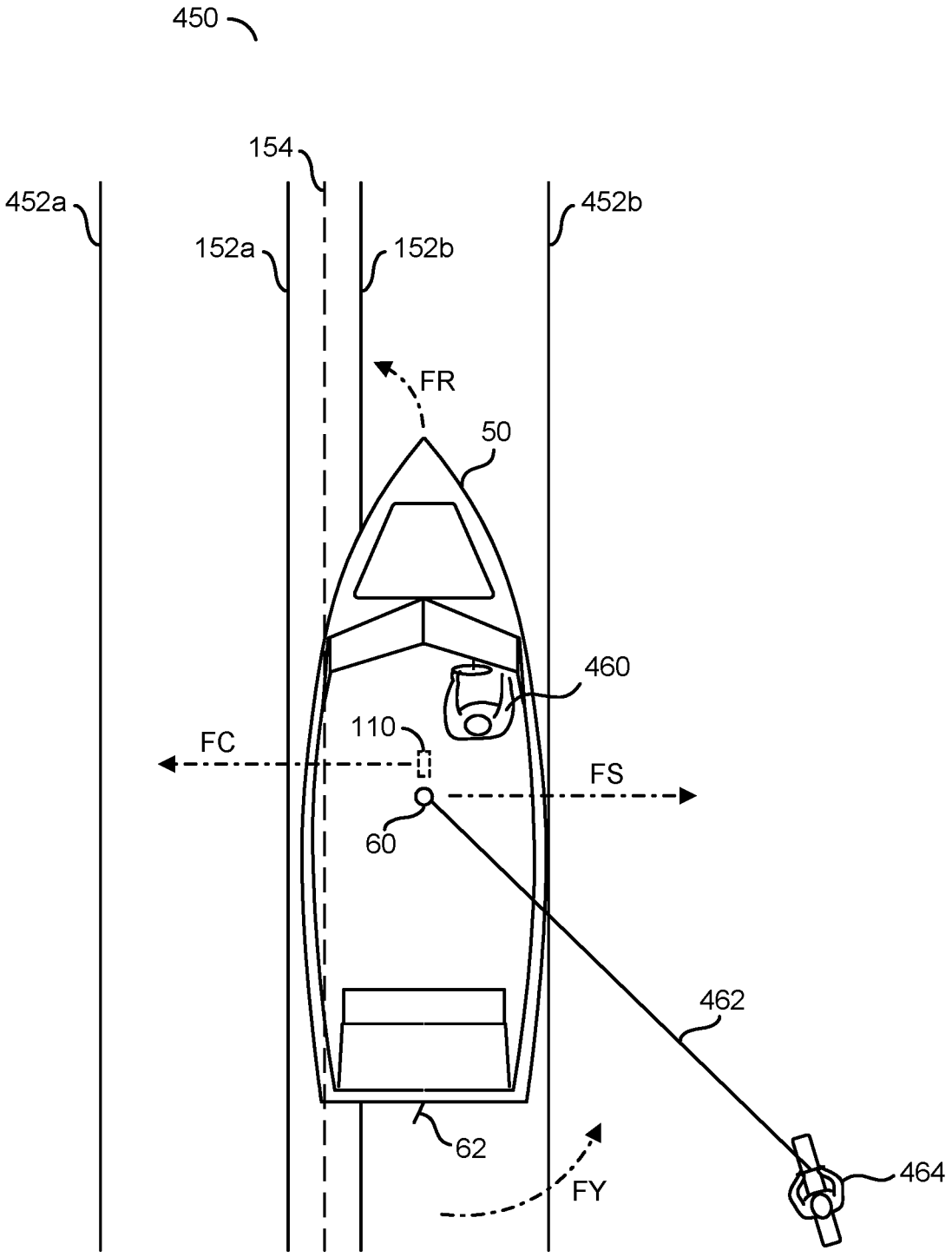
FIG. 11 is a diagram illustrating forces acting on the boat corrected by the control surface(s).

Referring to FIG. 11, a diagram illustrating forces acting on the boat corrected by the control surface(s) is shown. An example scenario 450 is shown. The example scenario 450 may illustrate an example overhead view of the boat 50 in a water ski course. The example scenario 450 may illustrate a correctional effect created by the control surface 110 regardless of how far the error (e.g., deviation from ideal DI) is from the predetermined centerline path 154.

The example scenario 450 may comprise the boat 50, the pylon 60, the rudder 62, the boundaries 152*a*-152*b* and the predetermined centerline path 154. A location of the control surface 110 is shown. The location of the control surface 110 may be next to the ski pylon 60 on the centerline 124 of the boat 50.

Guide paths 452*a*-452*b* are shown. The guide path 452*a* may be on a left side of the boundary 152*a* and the guide path 452*b* may be on a right side of the boundary 152*b*. The guide paths 452*a*-452*b* may provide a visual aid for keeping the boat 50 straight while traveling across the water ski course. In an example, the guide paths 452*a*-452*b* may be approximately 2.3 meters wide. In the example shown, the boat 50 may be within the guide paths 452*a*-452*b*. In some embodiments, a portion of the boat 50 may extend over one of the guide paths 452*a*-452*b*, even while the centerline 124 of the boat 50 is within the tolerance of the boundaries 152*a*-152*b*.

In the example scenario 450, a driver 460 is shown steering (e.g., manually controlling) the boat 50. A tow line 462 is shown attached to the pylon 60. A water skier 464 is shown being pulled by the boat 50 using the tow line 462.

The boat 50 is shown on the right: side of the predetermined centerline path 154 (e.g., laterally displaced to the right). The centerline 124 of the boat 50 may be over the boundary 152*b* (e.g., an example of poor driving by the driver 460, which may disqualify the water ski run for the water skier 464). The skier 464 may be behind and to the right side of the boat 50 (e.g., attempting to reach a buoy). A force (e.g., FS) of the skier pulling on the boat 50 is shown. Since the skier 464 is on the right side of the boat 50, the force FS may pull the boat 50 to the right (e.g., further away from the predetermined centerline path 154). The force FS may pull the boat 50 generally from the location of the pylon 60. For example, the force FS may be a lateral force of the water skier 464 that may be exerted on the pylon 60.

The driver 460 may attempt to manually steer the boat 50 back towards the predetermined centerline path 154 and/or attempt to manually counter the force FS from the water skier 464. To steer the boat 50 towards the predetermined centerline path 154, the rudder 62 may move to the left. Moving the rudder 62 to the left may create a force (e.g., FR) and a force (FY). The force FR and the force FY may rotate the boat 50. The force FR may direct a nose of the boat 50 towards the predetermined centerline path 154 to move the boat 50 to the left. The force FY may be a yaw force that may be induced by moving the rudder 62 to the left. The yaw force FY may cause the stern of the boat to swing out to the right. If the driver 460 is skilled, the boat 50 may be steered to the left with a small amount of the yaw force FY. The yaw force FY may be a force exerted on the boat 50 that may be caused by the driver 460.

The apparatus 100 may be configured to compare the actual location of the boat 50 to the predetermined centerline path 154. The apparatus 100 may determine the amount of corrective forces to apply. The processor 102 may generate the control signal CTRL to enable the actuator 104 to move the control surface 110.

A force (e.g., FC) is shown. The force FC may represent the correctional forces applied to the boat 50 by the control surface 110. The correctional force FC may be determined by the processor 102 in response to the comparison of the actual path 156 of the boat 50 to the predetermined centerline path 154. The correctional force FC may be directed towards the predetermined centerline path 154 in order to correct the deviation from ideal DI. The correctional force FC generated by the control surface 110 may move the boat 50 onto (or close to) the predetermined centerline path 154 and/or within the boundaries 152*a*-152*b* without inducing yaw.

The corrective force FC may enable the boat 50 to be moved directly over the predetermined centerline path 154. In response to the comparison of the actual location and/or path of the boat 50 with the predetermined centerline path 154, the apparatus 100 may enable the correction to be performed. In an example, the apparatus 100 may adjust the control surface 110 to move the boat 50 over the predetermined centerline path 154 without inducing yaw. In the example shown, the control surface 110 may be rotated to the left in order to create the corrective force FC to provide lateral movement to the left of the boat 50. For example, the corrective force FC may be large enough to overcome the skier force FS and create the lateral movement to the left. After the correction created by the corrective force FC, the entire centerline 124 of the boat 50 may be aligned with the predetermined centerline path 154. For example, the corrective forces FC may keep a direction of travel of a boat 50 centered axially on the predetermined centerline path 154 between two points (e.g., the start and finish of the water ski course).

The corrective force FC may counteract the force FS created by the water skier 464 at substantially the same point as the pylon 60 along the length of the boat 50. For example, the force FS may be exerted on the boat 50 at the pylon 60 and the corrective force FC may be opposite to the skier force FS and originate from the control surface 110. Providing the corrective force FC at the control surface 110 (e.g., close to the pylon 60) may provide the corrective force without inducing yaw. For example, since corrective force FC and the force FS may be located near a center of the boat 50, the corrective force FC that overcomes the force FS may not cause a significant amount of rotation of the boat 50.

When the boat 50 is moved over the predetermined centerline path 154 (e.g., the actual path 156 is aligned with the predetermined centerline path 154), the signal CTRL may be generated to move the control surface 110 to a neutral (or near neutral) position. Moving the control surface 110 to the neutral position may reduce the corrective force FC accordingly. Even while the centerline 124 of the boat 50 is located on the predetermined centerline path 154, the processor 102 may continually determine and/or predict a deviation of the actual path 156 from the predetermined centerline path 154. The processor 102 may enable the control surface 110 to provide continual and/or continuous maintenance (or management) of the corrective force FC in response to various forces that may act on the boat 50. In one example, the corrective force FC may be generated in response to predicting the skier force FS as the boat 50 approaches a turn buoy along the water ski course. In another example, the corrective force FC may be created in response to the driver 460 steering the boat 50 (e.g., the force FR and/or the yaw force FY). In yet another example, force created by wind and/or water currents on the boat may be counteracted by the corrective force FC. The types of forces that may be counteracted by controlling the control surface 110 may be varied according to the design criteria of a particular implementation.

As the skier 464 moves to the left side of the boat 50 (e.g., for the next turn buoy), the force FS may be applied to the left side of the boat 50 instead of the right side. The apparatus 100 may compare the actual path 156 of the boat 50 to the predetermined centerline path 154 to determine whether the boat 50 begins to drift to the left side of the predetermined centerline path 154. For example, when the water skier 464 exerts the force FS to the left of the boat 50, the corrective force FC may be adjusted to ensure that the overall forces acting on the boat 50 moves the centerline 124 of the boat 50 towards the predetermined centerline path 154. For example, if the boat 50 is to the right of the predetermined centerline path 154 and the skier 464 is exerting the force FS to the left of the boat 50, the corrective force FC may still be to the left of the boat 50, but at a smaller magnitude. In another example, if the boat 50 is to the left of the predetermined centerline path 154 and the skier 464 is exerting the force FS to the left of the boat 50, the corrective force FC may be to the right of the boat 50. The apparatus 100 may continually (or continuously) perform the measurements and/or comparisons to determine the movement of the control surface 110.

Figure 12:
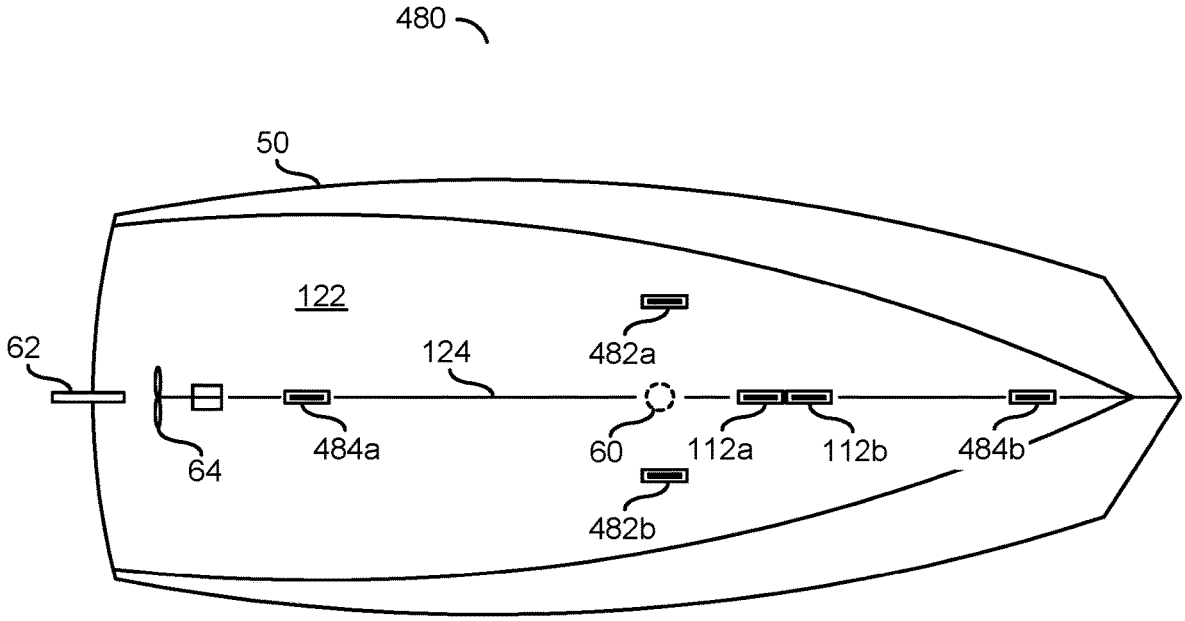
FIG. 12 is a bottom view of a boat illustrating an example arrangement of control surfaces.

Referring to FIG. 12, a bottom view of a boat illustrating an example arrangement of control surfaces is shown. A view 480 is shown. The view 480 may provide a view of the bottom of the boat 50 similar to the view 120 shown in association with FIG. 2. The location of the pylon 60, the rudder 62, the propeller 64, the tracking fins 112*a*-112*b*, the hull 122 and the centerline 124 are shown.

A pair of the control surfaces (e.g., 110*a*-110*b*) are shown implemented in two different arrangements. One arrangement 482*a*-482*b* of the control surfaces may not be located on the centerline 124 of the boat 50. One arrangement 484*a*-484*b* of the control surfaces may be located on the centerline 124. While the view 480 is illustrated showing both the arrangement 482*a*-482*b* and the arrangement 484*a*-484*b*, the apparatus 100 may be implemented with either the arrangement 482*a*-482*b* or the arrangement 484*a*-484*b*. Both of the arrangement 482*a*-482*b* and the arrangement 484*a*-484*b* may be a symmetrical orientation of the control surfaces.

In the arrangement 482*a*-482*b*, the control surface 482*a* is shown to the right of the pylon 60 and the control surface 482*b* is shown to the left of the pylon 60 (e.g., directly across from each other and neither on the centerline 124 with the pylon 60 in between). The arrangement 482*a*-482*b* may represent a symmetrical orientation of the control surfaces on either side of the centerline 124 of the boat 50. In the arrangement 484*a*-484*b*, the control surface 484*a* is shown to the rear of the pylon 60 and the control surface 484*b* is shown to the front of the pylon 60 (e.g., both on the centerline 124 with the pylon 60 in between).

The control surfaces in the arrangement 482*a*-482*b* may be configured to operate as two movable fins on either side of the centerline 124. The control surfaces in the arrangement 484*a*-484*b* may be configured to operate as two movable fins in front of and to the rear of the pylon 60 on the centerline 124. The control surfaces in both the arrangement 482*a*-482*b* and/or the arrangement 484*a*-484*b* may be controlled by the apparatus 100 to operate in tandem to bring about a lateral force without inducing yaw. The control surfaces in both the arrangement 482*a*-482*b* and/or the arrangement 484*a*-484*b*, when operated together may create the lateral force without inducing yaw as if there were a single control surface operating substantially at the center of the boat 50. For example, the lateral forces created by each of the control surfaces in both the arrangement 482*a*-482*b* and/or the arrangement 484*a*-484*b* may be equivalent to a single force acting at the center of gravity of the boat 50. One of the control surfaces may be moved, which may deliberately induce yaw in a first direction, and the other of the control surfaces may deliberately induce yaw in a second direction that may counter the yaw from the other control surface, in order to result in a net zero yaw actually being induced.

In the example shown, the control surfaces in the arrangement 482*a*-482*b* are both offset in opposite directions from the centerline 124 and the pylon 60 (e.g., the control surface 482*a* is to the right and the control surface 482*b* is to the left). In some embodiments, more than two of the control surfaces may be implemented. The number and/or arrangement of the control surfaces 110*a*-110*b* may be varied according to the design criteria of a particular implementation.

Figure 13:
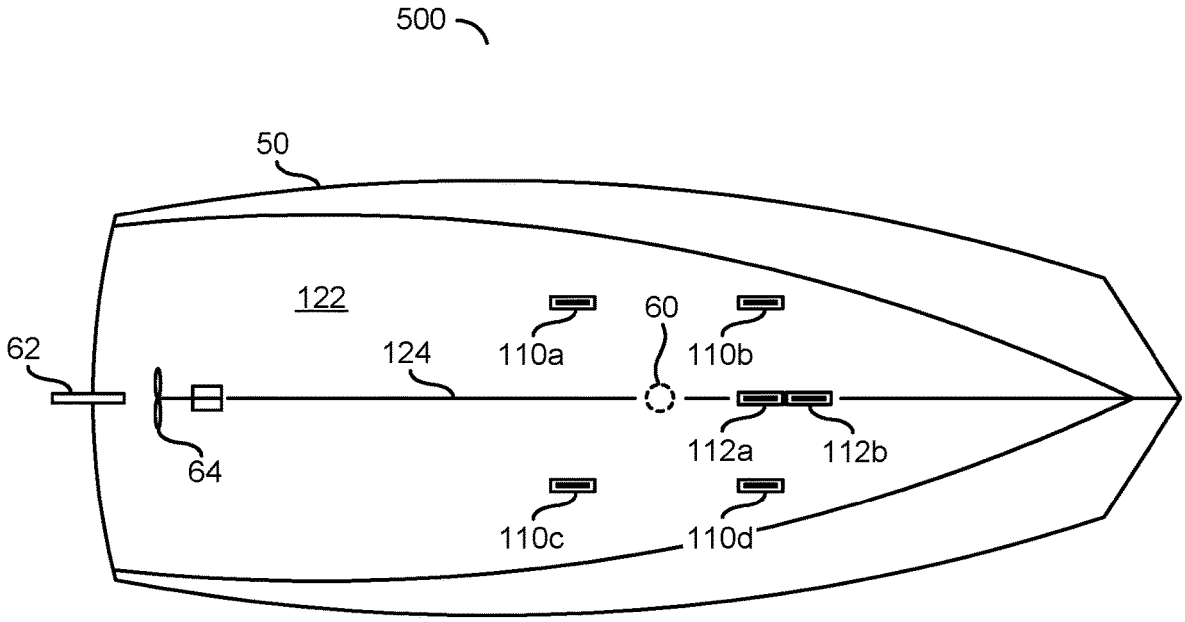
FIG. 13 is a bottom view of a boat illustrating an alternate example arrangement of control surfaces.

Referring to FIG. 13, a bottom view of a boat illustrating an alternate example arrangement of control surfaces is shown. The view 500 may provide a view of the bottom of the boat 50 similar to the view 120 shown in association with FIG. 2. The location of the pylon 60, the rudder 62, the propeller 64, the tracking fins 112*a*-112*b*, the hull 122 and the centerline 124 are shown.

The control surfaces 110*a*-110*d* are shown. In the view 500, the control surfaces 110*a*-110*d* may not be located on the centerline 124 of the boat 50. The control surface 110*a* is shown to the rear and to the right of the pylon 60. The control surface 110*b* is shown to the front and the right of the pylon 60. The control surface 110*c* is shown to the rear and to the left of the pylon 60. The control surface 110*d* is shown to the front and to the left of the pylon 60. The control surfaces 110*a*-110*d* may be located at the corners of a square shape around the pylon 60.

The control surfaces 110*a*-110*d* may operate together to create the lateral forces without inducing yaw. Each of the control surfaces 110*a*-110*d* may induce yaw, but counteract the yaw induced by the other of the control surfaces to result in a net zero amount of yaw on the boat 50.

In some embodiments, each of the control surfaces 110*a*-110*d* may implement the adjustable fin 110. In some embodiments, each of the control surfaces 110*a*-110*d* may implement the trim tab fin 110'. In some embodiments, some of the control surfaces 110*a*-110*d* may implement a combination of the adjustable fin 110 the trim tab fin 110'. The types of fins implemented and/or the distance from the pylon 60 that the control surfaces 110*a*-110*d* are implemented may be varied according to the design criteria of a particular implementation.

Figure 14:
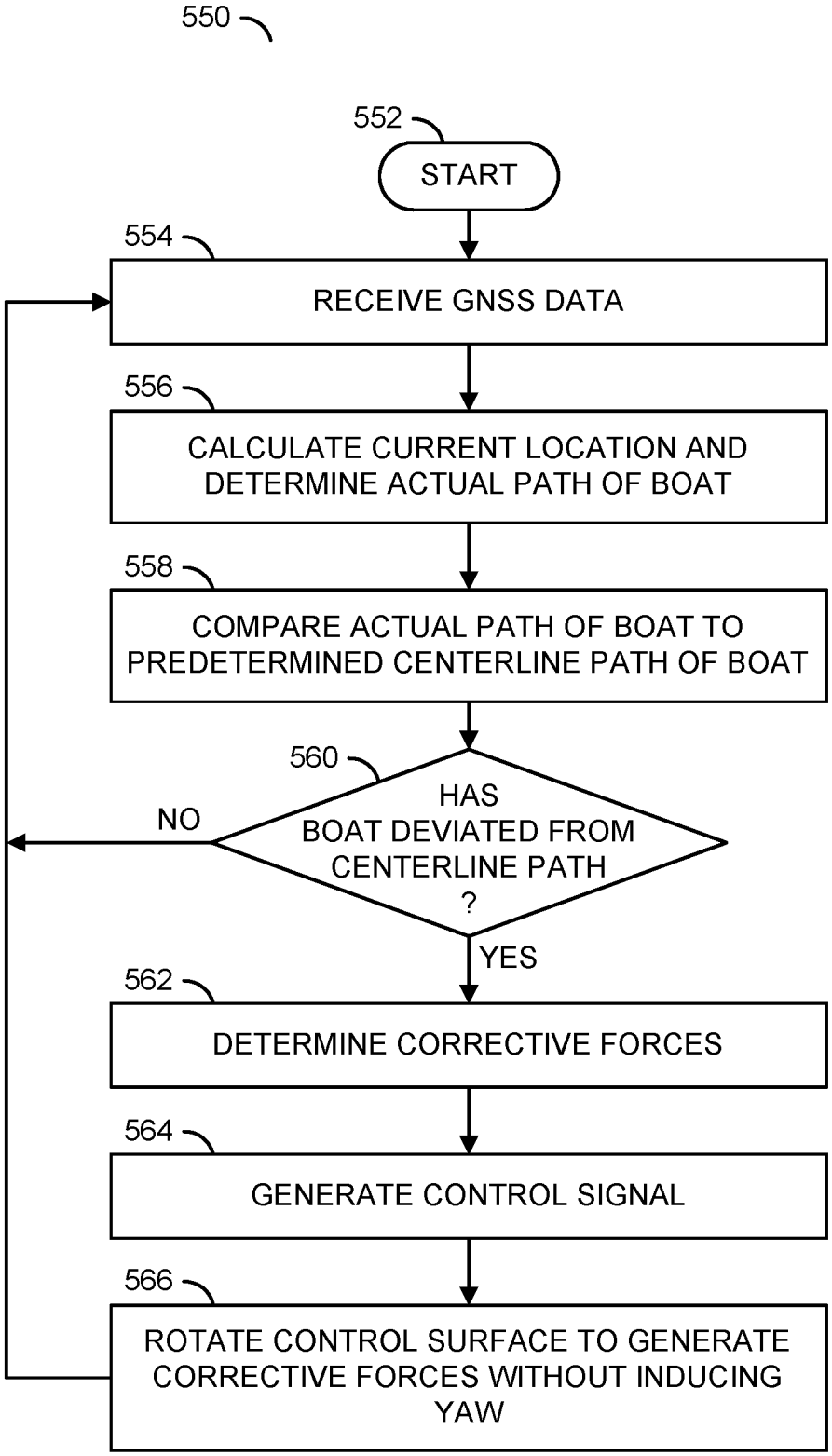
FIG. 14 is a flow diagram illustrating a method for adjusting a control surface in response to a comparison between an actual path and a predetermined centerline path.

Referring to FIG. 14, a method (or process) 550 is shown. The method 550 may adjust a control surface in response to a comparison between an actual path and a predetermined centerline path. The method 550 generally comprises a step (or state) 552, a step (or state) 554, a step (or state) 556, a step (or state) 558, a decision step (or state) 560, a step (or state) 562, a step (or state) 564, and a step (or state) 566.

The step 552 may start the method 550. Next, in the step 554, the processor 102 may receive the GNSS data. In one example, the processor 102 may receive the signal POS (e.g., calculated by the GNSS system 232). In another example, the processor 102 may receive the signal COMM from the satellite 54 and calculate the GNSS coordinates. In the step 556, the processor 102 may calculate the current location of the boat 50 and determine the actual path 156 of the boat 50. Next, in the step 558, the processor 102 may compare the actual path 156 of the boat to the predetermined centerline path 154 to determine an amount and direction of deviation. The predetermined centerline path 154 may be stored in the memory 240. Next, the method 550 may move to the decision step 560.

In the decision step 560, the processor 102 may determine whether the centerline 124 of the boat 50 has deviated from the predetermined centerline path 154. For example, when the actual path 156 of the boat 50 does not overlap exactly with the predetermined centerline path 154, the processor 102 may detect the deviation. If there is no deviation detected, then the method 550 may return to the step 554. If there is a deviation detected, then the method 550 may move to the step 562.

In the step 562, the processor 102 may determine the corrective forces. The corrective forces may be calculated that may create the desired lateral forces to bring the centerline 124 of the boat 50 into alignment with the predetermined centerline path 154. Next, in the step 564, the processor 102 may generate the control signal CTRL. The control signal CTRL may be presented to the actuator (or actuators) 104. In the step 566, the actuator 104 may rotate the control surface 110 to generate the corrective forces without inducing yaw. For example, the actuator 104 may move the pivot 280 in order to rotate the adjustable fin 110. Next, the method 550 may return to the step 554.

Figure 15:
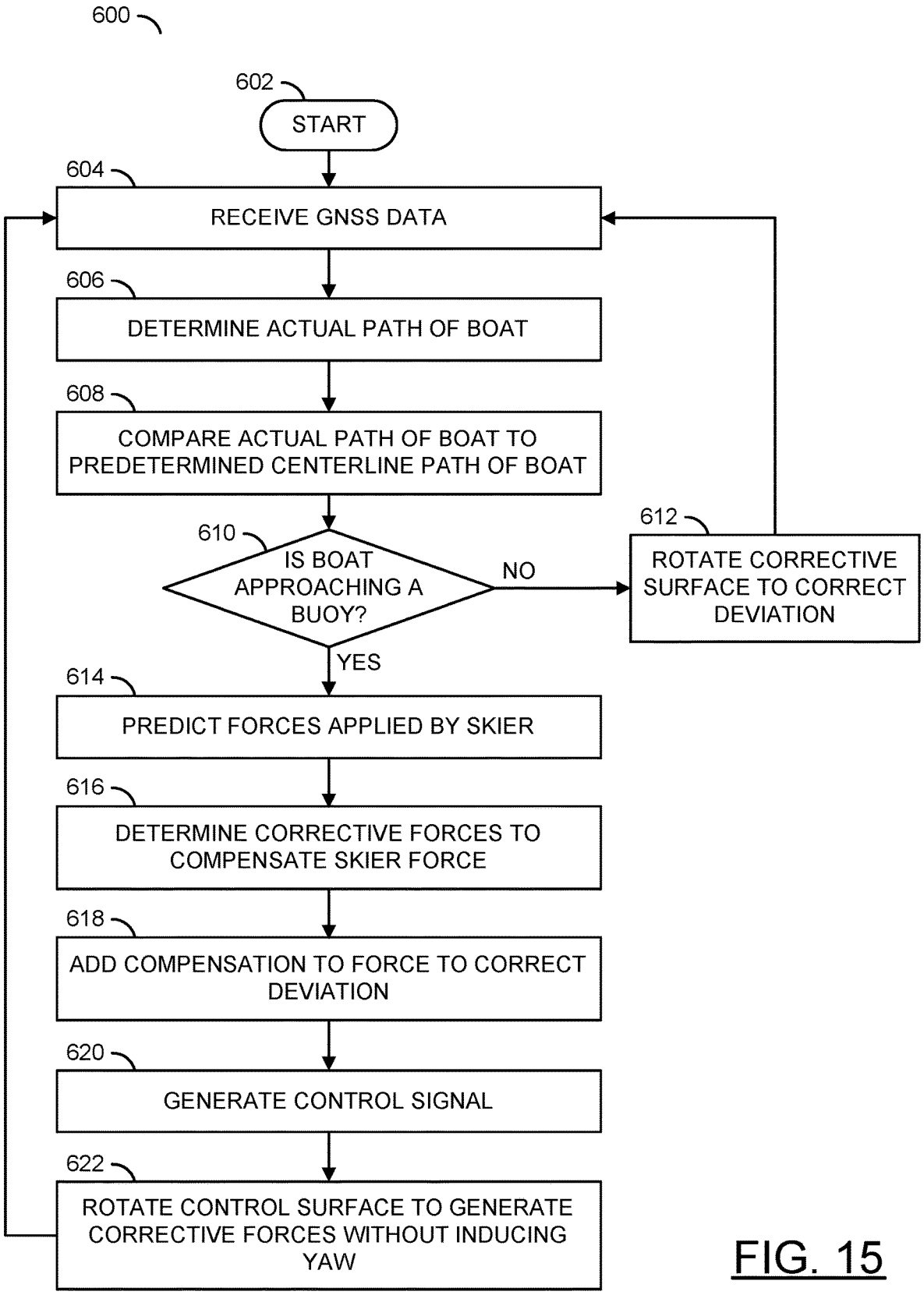
FIG. 15 is a flow diagram illustrating a method for determining corrective forces and compensating for anticipated skier forces.

Referring to FIG. 15, a method (or process) 600 is shown. The method 600 may determine corrective forces and compensate for anticipated skier forces. The method 600 generally comprises a step (or state) 602, a step (or state) 604, a step (or state) 606, a step (or state) 608, a decision step (or state) 610, a step (or state) 612, a step (or state) 614, a step (or state) 616, a step (or state) 618, a step (or state) 620, and a step (or state) 622. The step 602 may start the method 600. In the step 604, the processor 102 may receive the GNSS data. Next, in the step 606, the processor 102 may determine the actual path 156 of the boat 50. In the step 608, the processor 102 may compare the actual path 156 of the boat 50 to the predetermined centerline path 154 of the boat 50. Next, the method 600 may move to the decision step 610.

In the decision step 610, the processor 102 may determine whether the boat 50 is approaching a buoy (or a region after a buoy where large forces from the skier are expected). The memory 240 may store information about the water ski course, such as the locations of the buoys and/or locations where large forces are expected along the predetermined centerline path 154. If the boat 50 is not approaching one of the buoys (or a region where large forces are expected), then the method 600 may move to the step 612. In the step 612, the apparatus 100 may rotate the corrective surface 110 to correct the deviation (e.g., similar to the method 550 as described in association with FIG. 14). Next, the method 600 may return to the step 604. In the decision step 610, if the boat 50 is approaching one of the buoys (or a region where large forces are expected), then the method 600 may move to the step 614.

In the step 614, the processor 102 may predict the force FS that may be applied by the skier 464. In an example, the memory 240 may comprise a lookup table that stores information about the skier 464 and/or historical information about the amount of the force FS applied by the skier 464 (or data from many skiers). Next, in the step 616, the processor 102 may determine the corrective forces that may be applied in order to compensate for the force FS that may be applied by the skier 464. In the step 618, the processor 102 may add the compensation to the force FS to the corrective forces for the deviation from the comparison between the actual path 156 and the predetermined centerline path 154 in order to correct the deviation. Next, in the step 620, the processor 102 may generate the control signal CTRL. In the step 622, the actuator 104 may respond to the control signal CTRL in order to move the control surface 110 to generate the calculated corrective forces without inducing yaw. Next, the method 600 may return to the step 604.

In an ideal scenario, the apparatus 100 may provide all of the control (e.g., lateral control) of the boat 50 across the water ski course. For example, the driver 460 may align the boat as best as possible to the predetermined centerline path 154 at a start line of the water ski course. After the boat 50 is initially aligned with the predetermined centerline path 154, the apparatus 100 may take over control (e.g., steering) of the boat 50. For example, any manual steering of the boat 50 by the driver 460 may override (e.g., fight against) the correctional force FC created by the control surface 110. The control signal CTRL generated by the processor 102 may enable the actuator 104 to adjust the control surface 110 in order to provide the lateral movement of the boat 50 to manage the location of the boat 50 with respect to the predetermined centerline path 154.

After the driver 460 lines up the boat 50 with the predetermined centerline path 154 (e.g., within approximately two feet and with no yaw), the apparatus 100 may compare the actual path 156 of the boat 50 with the predetermined path 154 in order to bring the centerline 124 of the boat 50 onto the predetermined centerline path 154. The driver 460 may attempt to manually steer (e.g., to correct any yaw). Generally, any input by the driver 460 may be minimal and all lateral corrections may be generated by the apparatus 100.

While the apparatus 100 controls the lateral corrections for the boat 50, the driver 460 may have an opportunity to focus less on manual steering. For example, the driver 460 of the boat 50 may be able to concentrate less on steering and instead focus on the water skier 464 (e.g., to provide coaching). The driver 460 may be able to override the corrective forces FC generated in response to the apparatus 100. Even though the apparatus 100 may be capable of keeping the boat 50 over the predetermined centerline path 154, the driver 460 may still look down the water ski course and provide manual steering to avoid any potential obstacles. For example, families of swans may cross the water ski course and the driver 460 may still have the ability to steer the boat 50 to avoid a swan (or family of swans).

In some embodiments, the apparatus 100 may be made available (e.g., sold) as a prefabricated product. For example, the control surface 110 may be sold already mounted to the boat 50 and the processor 102 and/or the actuator may be preinstalled in the boat 50 (e.g., sold together with a new boat). In some embodiments, the control surface 110 may be sold as a unit with the actuator 104. For example, the control surface 110 may be a prefabricated fin with the pipe 302 and the splined shaft 304 connected to the actuator 104 that may be bolted (e.g., mounted) to the boat 50. In some embodiments, the apparatus 100 may be sold as a modification to an existing fin (e.g., a retrofit). For example, a boat owner may drill a hole through the hull 122 of the boat 50 in order to insert the pipe 302 and the splined shaft 304. The installation method of providing the apparatus 100 with the boat 50 may be varied according to the design criteria of a particular implementation.

The functions performed by the diagrams of FIGS. 1-15 may be implemented using one or more of a conventional general purpose processor, digital computer, microprocessor, microcontroller, RISC (reduced instruction set computer) processor, CISC (complex instruction set computer) processor, SIMD (single instruction multiple data) processor, signal processor, central processing unit (CPU), arithmetic logic unit (ALU), video digital signal processor (VDSP) and/or similar computational machines, programmed according to the teachings of the specification, as will be apparent to those skilled in the relevant art(s).

Appropriate software, firmware, coding, routines, instructions, opcodes, microcode, and/or program modules may readily be prepared by skilled programmers based on the teachings of the disclosure, as will also be apparent to those skilled in the relevant art(s). The software is generally executed from a medium or several media by one or more of the processors of the machine implementation.

The invention may also be implemented by the preparation of ASICS (application specific integrated circuits), Platform ASICs, FPGAs (field programmable gate arrays), PLDs (programmable logic devices), CPLDs (complex programmable logic devices), sea-of-gates, RFICS frequency integrated circuits), ASSPS (radio (application specific standard products), one or more monolithic integrated circuits, one or more chips or die arranged as flip-chip modules and/or multi-chip modules or by interconnecting an appropriate network of conventional component circuits, as is described herein, modifications of which will be readily apparent to those skilled in the art(s).

The invention thus may also include a computer product which may be a storage medium or media and/or a transmission medium or media including instructions which may be used to program a machine to perform one or more processes or methods in accordance with the invention. Execution of instructions contained in the computer product by the machine, along with operations of surrounding circuitry, may transform input data into one or more files on the storage medium and/or one or more output signals representative of a physical object or substance, such as an audio and/or visual depiction. The storage medium may include, but is not limited to, any type of disk including floppy disk, hard drive, magnetic disk, optical disk, CD-ROM, DVD and magneto-optical disks and circuits such as ROMs (read-only memories), RAMS (random access memories), EPROMS (erasable programmable ROMS), EEPROMS (electrically erasable programmable ROMs), UVPROMS (ultra-violet erasable programmable ROMs), Flash memory, magnetic cards, optical cards, and/or any type of media suitable for storing electronic instructions.

The elements of the invention may form part or all of one or more devices, units, components, systems, machines and/or apparatuses. The devices may include, but are not limited to, servers, workstations, storage array controllers, storage systems, personal computers, laptop computers, notebook computers, palm computers, cloud servers, personal digital assistants, portable electronic devices, battery powered devices, set-top boxes, encoders, decoders, transcoders, compressors, decompressors, pre-processors, post-processors, transmitters, receivers, transceivers, cipher circuits, cellular telephones, digital cameras, positioning and/or navigation systems, medical equipment, heads-up displays, wireless devices, audio recording, audio storage and/or audio playback devices, video recording, video storage and/or video playback devices, game platforms, peripherals and/or multi-chip modules. Those skilled in the relevant art(s) would understand that the elements of the invention may be implemented in other types of devices to meet the criteria of a particular application.

The terms "may" and "generally" when used herein in conjunction with "is (are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

The designations of various components, modules and/or circuits as "a"-"n", when used herein, disclose either a singular component, module and/or circuit or a plurality of such components, modules and/or circuits, with the "n" designation applied to mean any particular integer number. Different components, modules and/or circuits that each have instances (or occurrences) with designations of "a"-"n" may indicate that the different components, modules and/or circuits may have a matching number of instances or a different number of instances. The instance designated "a" may represent a first of a plurality of instances and the instance "n" may refer to a last of a plurality of instances, while not implying a particular number of instances.

While the invention has been particularly shown and described with reference to embodiments thereof, it will be understood by those skilled in the art that various changes in form and details may be made without departing from the scope of the invention.

The invention claimed is:

1. An apparatus comprising:

a processor configured to generate a control signal in response to (a) an actual path of a boat determined in response to signals received from GNSS satellites and (b) a predetermined centerline path of said boat; and an actuator configured to move a control surface mounted on a centerline of said boat in response to said control signal, wherein (i) said processor is configured to calculate said control signal by comparing said actual path of said boat relative to said predetermined centerline path, (ii) said control signal is calculated by said processor in real time as said actual path of said boat changes in response to a deviation from said predetermined centerline path caused by a force acting on said boat, (iii) said boat is configured to (a) change direction by inducing yaw in response to moving a direction of a rudder and (b) change direction without inducing said yaw in response to microcorrections provided by said control surface, (iv) moving said direction of said rudder is controlled separately from said microcorrections provided by said control surface, and (v) said control surface provides said microcorrections to said actual path of said boat to center said actual path axially along said predetermined centerline path.

2. The apparatus according to claim 1, wherein said force acting on said boat is a lateral force applied by a water skier towed by said boat.

3. The apparatus according to claim 2, wherein (i) said processor is further configured to predict an amount of said lateral force applied by said water skier on said boat and (ii) said microcorrections calculated by said processor comprise (a) correcting said deviation between said actual path and said predetermined centerline path and (b) compensating for said amount of said lateral force applied by said water skier predicted by said processor.

4. The apparatus according to claim 3, further comprising a memory configured to store a location of buoys along said predetermined centerline path, wherein said processor is configured to predict said amount of said lateral force based on said location of said buoys.

5. The apparatus according to claim 2, wherein said lateral force of said water skier is (i) exerted on a pylon for towing said water skier and (ii) counteracted by said control surface at substantially the same point as said pylon along a length of said boat.

6. The apparatus according to claim 1, wherein said control surface is a fin implemented separately from said rudder of said boat.

7. The apparatus according to claim 1, wherein said control surface is mounted on an underside of said boat near a position where a ski pylon attaches to a hull of said boat.

8. The apparatus according to claim 1, wherein (i) said control surface is configured to apply corrective lateral forces to adjust said actual path of said boat relative to said predetermined centerline path and (ii) said corrective lateral forces are applied to said boat laterally without inducing any of said yaw.

9. The apparatus according to claim 1, further comprising a memory configured to store (i) computer readable instructions and (ii) said predetermined centerline path of said boat, wherein said processor is configured to execute said computer readable instructions to perform steps of:

(a) calculating said actual path of said boat from said signals received from said GNSS satellites, (b) comparing said actual path of said boat with respect to said predetermined centerline path of said boat, (d) determining a current orientation of said control surface, (e) calculating corrective lateral forces to adjust said actual path of said boat relative to said predetermined centerline path, and (f) generating said control signal to adjust said current orientation of said control surface to a position that provides said corrective lateral forces.

10. The apparatus according to claim 1, wherein said actuator is configured to rotate said control surface about a pivot point to provide said microcorrections.

11. The apparatus according to claim 10, wherein (i) said control surface is a rotatable fin and (ii) said pivot point is located closer to a leading edge of said rotatable fin than a trailing edge of said rotatable fin.

12. The apparatus according to claim 1, wherein said (i) said control surface is a fixed fin comprising a trim tab and (ii) said actuator is configured to rotate said trim tab to provide said microcorrections.

13. The apparatus according to claim 1, further comprising a second control surface located on said centerline of said boat, wherein (i) said control surface is located on a first side of a ski pylon attached to said boat and (ii) said second control surface is located on a second side of said ski pylon.

14. The apparatus according to claim 13, further comprising a second actuator configured to move said second control surface, wherein said processor further is configured to (i) determine first corrective forces for said control surface, (ii) determine second corrective forces for said second control surface, (iii) present said control signal to said actuator to move said control surface to create said first corrective forces and (iv) present a second control signal to said second actuator to move said second control surface to create said second corrective forces.

15. The apparatus according to claim 13, wherein (i) said control surface is a first fin and said second control surface is a second fin and (ii) said first fin and said second fin are operated together to create a lateral force without inducing said yaw.

16. The apparatus according to claim 1, wherein said force acting on said boat is caused by a driver of said boat steering along said predetermined centerline path by moving said direction of said rudder.

17. The apparatus according to claim 1, wherein said force acting on said boat is caused by at least one of wind and a water current.

18. The apparatus according to claim 1, wherein said control signal is configured to dynamically control said control surface in response to said deviation in real time.

19. The apparatus according to claim 1, wherein (i) said boat is aligned with said predetermined centerline path at a start of a water ski course and (ii) said control signal is configured to enable said control surface to maintain an alignment of said actual path of said boat with said predetermined centerline path across said water ski course without a driver of said boat steering.

20. An apparatus comprising:

a processor configured to generate a control signal in response to (a) an actual path of a boat determined in response to signals received from GNSS satellites and (b) a predetermined centerline path of said boat; and an actuator configured to move a plurality of control surfaces mounted to said boat in response to said control signal, wherein (i) said processor is configured to calculate said control signal by comparing said actual path of said boat relative to said predetermined centerline path, (ii) said control signal is calculated by said processor in real time as said actual path of said boat changes in response to a deviation from said predetermined centerline path caused by a force acting on said boat, (iii) said boat is configured to (a) change direction by inducing yaw in response to moving a direction of a rudder and (b) change direction without inducing said yaw in response to microcorrections provided by said plurality of control surfaces, (iv) moving said direction of said rudder is controlled separately from said microcorrections provided by said plurality of control surfaces, (v) said control surfaces provide adjustments to said actual path of said boat to center said actual path axially along said predetermined centerline path, and (vi) said plurality of control surfaces are arranged in an orientation such that (a) none of said plurality of control surfaces are mounted on said centerline of said boat and (b) each of said plurality of control surfaces on a first side of said centerline of said boat has a corresponding one of said plurality of said control surfaces located symmetrically on a second side of said centerline of said boat.

* * * * *